US007478785B2

(12) United States Patent
Herron, III et al.

(10) Patent No.: US 7,478,785 B2
(45) Date of Patent: Jan. 20, 2009

(54) VERTICALLY STABILIZED ADJUSTABLE SHELF BRACKET ASSEMBLY

(75) Inventors: Warren L. Herron, III, Gulf Breeze, FL (US); Warren L. Herron, Jr., Gulf Breeze, FL (US); Mark Bennett, Norcross, GA (US); Randall Bachtel, Duluth, GA (US)

(73) Assignee: Herron Intellectual Property Holdings, LLC, Gulf Breeze, FL (US)

( * ) Notice: Subject to any disclaimer, the term of this patent is extended or adjusted under 35 U.S.C. 154(b) by 499 days.

(21) Appl. No.: 10/737,443

(22) Filed: Dec. 15, 2003

(65) Prior Publication Data

US 2004/0173549 A1 Sep. 9, 2004

Related U.S. Application Data

(63) Continuation-in-part of application No. 09/799,853, filed on Mar. 5, 2001, now Pat. No. 6,663,201, and a continuation-in-part of application No. 09/255,258, filed on Feb. 22, 1999, now Pat. No. 6,196,141.

(51) Int. Cl.
*A47G 29/02* (2006.01)

(52) U.S. Cl. ..... 248/243; 248/250; 248/221.11; 211/187

(58) Field of Classification Search ..... 248/243, 248/220.22, 231.71, 345.1, 250, 231.31, 248/464, 220.21, 221.11, 235; 211/187, 211/90.02, 87.01, 90, 90.03, 193, 206, 105.1, 211/106.1, 134; 312/245–246; 108/106–109
See application file for complete search history.

(56) References Cited

U.S. PATENT DOCUMENTS 3,233,852 A * 2/1966 Azar ..... 248/68.1
3,269,553 A 8/1966 Ruhnke
3,353,684 A * 11/1967 Chesley ..... 211/187
3,614,044 A * 10/1971 Bard ..... 248/113
3,701,325 A * 10/1972 Fenwick ..... 108/1
4,055,318 A * 10/1977 Duckett ..... 248/243
4,431,155 A * 2/1984 Engel ..... 248/243
4,826,115 A 5/1989 Novitski
4,874,148 A 10/1989 Guinter
5,253,835 A * 10/1993 Herron, III ..... 248/220.22
5,346,077 A * 9/1994 Randall ..... 211/90.03
5,423,510 A * 6/1995 Almoslino ..... 248/345.1
5,472,103 A 12/1995 Merl
5,799,803 A * 9/1998 Muller ..... 211/90.01
6,079,803 A * 6/2000 West et al. ..... 312/107
6,196,141 B1 * 3/2001 Herron et al. ..... 108/108
6,378,709 B1 * 4/2002 Stuart ..... 211/87.01
D481,560 S * 11/2003 Vidmar et al. ..... D6/491
6,663,201 B2 * 12/2003 Herron et al. ..... 312/245
2004/0173549 A1 * 9/2004 Herron et al. ..... 211/90.02

* cited by examiner

*Primary Examiner*—Amy J. Sterling
*Assistant Examiner*—Tan Le
(74) *Attorney, Agent, or Firm*—Roy, Kiesel, Keegan & DeNicola

(57) ABSTRACT

A vertically stabilized shelf bracket assembly having at least two support strips on which a plurality of shelf brackets are mounted. A cover is provided that aesthetically enhances the shelf bracket assembly and stabilizes it at the same time. In one embodiment, the cover includes a cap and a hanging casing. In one embodiment, apertures are provided in the shelf brackets to support a rod. In another embodiment an adjustable mounting slot is provided in the support strips to facilitate their parallel installation.

4 Claims, 33 Drawing Sheets

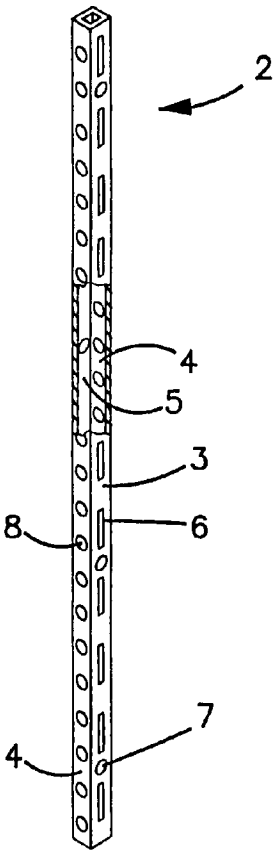
FIGURE 1A
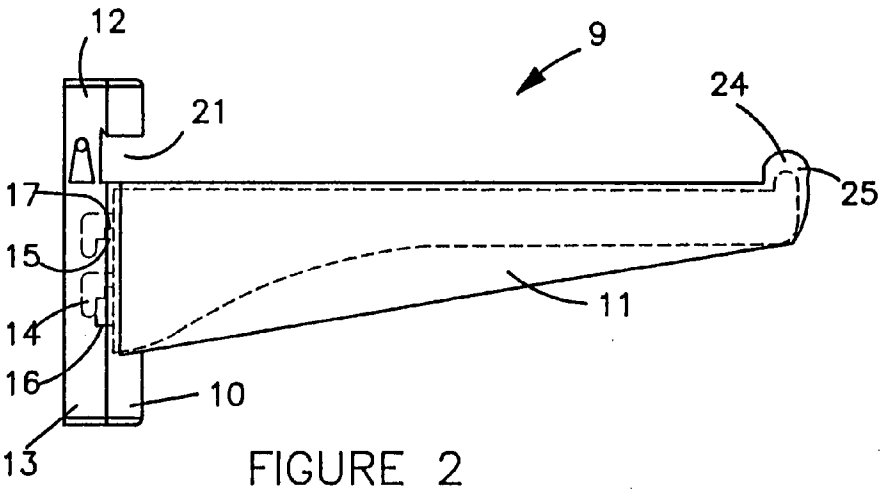
FIGURE 2
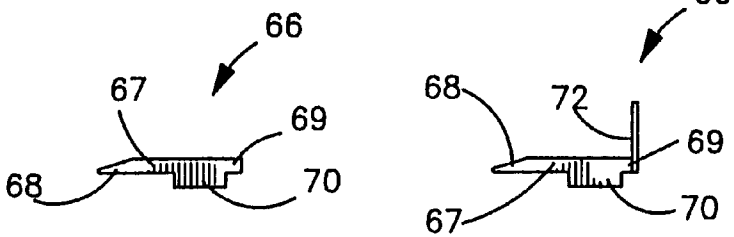
FIGURE 7A
FIGURE 7B
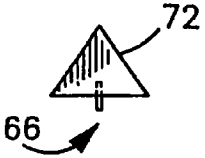
FIGURE 7C

VERTICALLY STABILIZED ADJUSTABLE SHELF BRACKET ASSEMBLY

CONTINUATION-IN-PART INFORMATION

This is a Continuation-in-Part of U.S. patent application Ser. No. 09/255,258, filed Feb. 22, 1999, now U.S. Pat. No. 6,196,141, and U.S. patent application Ser. No. 09/799,853, filed Mar. 5, 2001 which will issue as U.S. Pat. No. 6,663,201 on Dec. 16, 2003, and which are both hereby incorporated by reference, in their entirety.

BACKGROUND OF THE INVENTION

1. Field of the Invention

The invention relates to adjustable shelf support systems in general, and more particularly to shelf support systems employing slotted shelf support strips.

2. Prior Art

A common adjustable shelving design in the prior art utilizes a design disclosed in U.S. Pat. No. 4,070,803 to Gartung, which is hereby incorporated by reference. This shelving system consists essentially of two or more vertical support strips containing a plurality of vertically aligned slots. Shelf support brackets having hooks designed to engage the slots in the support strips are attached to the strips. By positioning two or more strips parallel to each other on a wall, and aligning two or more brackets horizontally on the strips, the brackets can be used to support shelving. This type of shelving system provides a significant advantage over the prior art in that it may be installed over walls without requiring any alterations to the wall itself. However, the Gartung type shelving also have a significant shortcoming: stability. The hooks securing the brackets to the strips are much shorter than the brackets themselves. Force exerted against the shelves can use the full length of the brackets to exert leverage against the hooks. For this reason, small lateral forces can cause the brackets and the shelves they support to sway substantially. Gartung type shelving system also have vertical stability problems. The shelves are typically held on the brackets by their own weight. This can create problems if the shelf becomes unevenly laden. Consider a shelf supporting a collection of valuable but fragile lamps on one end and a bronze sculpture on the other. Lifting the sculpture during household cleaning may cause the shelf to become unbalanced and allow it to pivot on the bracket, and may lead to a tumble for the lamps. The shelves are also quite susceptible to displacement from upward forces. A shelf struck from below with a heavy object such as a dictionary being moved on a lower shelf may move upward with nothing but gravity to oppose it. If the bracket itself is bumped from below, it may be displaced and possibly even knocked out of the strip. Previous works, such as U.S. Pat. No. 5,253,835 to Herron which is hereby incorporated by reference in its entirety, have made substantial improvements to the horizontal stability of the shelving; however, problems persist in the state of the art with respect to the vertical stability of Gartung type shelving. Therefore, a shelving system satisfying the following objectives is desired.

OBJECTS OF THE INVENTION

It is an object of the invention to provide a shelf bracket assembly in which the shelves are substantially stable.

It is another object of the invention to provide a shelf bracket assembly in which the shelves are substantially vertically stable.

It is another object of the invention to provide a shelf bracket assembly in which the shelves may be easily adjusted.

It is yet another object of the invention to provide a shelf bracket assembly which is aesthetically pleasing.

SUMMARY OF THE INVENTION

A shelf bracket assembly is disclosed for providing improved vertical stability to adjustable shelves. The assembly comprises a plurality of Gartung type support strips, containing a plurality of vertically aligned slots along their length. A plurality of shelf brackets having a base and a horizontal support member extending from the base are provided. The base contains at least one hooked portion sized to fit in and engage the vertically aligned slots of the support strips. The shelves are stabilized vertically in several ways. First the base is provided with a recess for receiving the shelf. The shelf is either sized to fit securely in the recess or the recess is provided with a shim to secure the shelf in the recess. Second, a vertical member may extend upwardly from the horizontal support member, preferably at the end of the horizontal support member opposite the base. A slot or an indentation may be provided in the shelf to receive the vertical member. The slot or indentation and the vertical member are preferably configured to engage one another so that the shelf is releasably attached to the horizontal member. This may be accomplished by providing the vertical member with an enlarged head and providing the slot or indentation with a deformable constriction sized to engage the head. With the shelf attached to the horizontal support member at one end by the vertical member and at the other end in the recess, the shelf is secured to the horizontal support member so that it cannot pivot vertically along its width. Securing the shelf to another horizontal support member attached to a parallel support strip will provide additional vertical stability along the shelf length. In this position, the shelf can be displaced vertically only by moving the entire support bracket upward, as would be done to remove the bracket from the support strip.

Additional vertical stability may be provided by securing the brackets against upward movement. One way this can be accomplished is to provide the support strips with a plurality of horizontally and vertically aligned strip apertures. At least one corresponding base aperture is provided in the base of the brackets. The locking apertures and the base aperture should be positioned and sized to align when the bracket is engaged with the support strip. A locking pin is also provided which is sized to be inserted into the locking apertures and the base apertures. By placing the locking pin in these apertures when the bracket is engaged with the support strip, upward movement of the bracket may be prevented.

The brackets may also be provided with a vertical stabilizer configured to engage the shelf support strips. The vertical stabilizer comprises an elongated member having a top end, a bottom end, and an arm extending perpendicularly therefrom. The arm is sized to fit into the slots of the support strips. The vertical stabilizer is sized and configured so that the bottom end of the elongated member will be positioned above and in close contact with the base of the shelf bracket. These stabilizers are designed to be held in place by a cover means such as described in U.S. Pat. No. 5,253,835. With the stabilizer and cover means in place, the bracket cannot be moved upwardly.

BRIEF DESCRIPTION OF THE DRAWINGS

FIG. 1A is a perspective partial cut-away view of a preferred embodiment of a support strip.

FIG. 2 is a side view of a preferred embodiment of a shelf bracket having a vertical member and a recess.

FIG. 7A is a side view of a preferred embodiment of a vertical stabilizer.

FIG. 7B is a side view of another preferred embodiment of a vertical stabilizer having a lateral brace.

FIG. 7C is an end view of the preferred embodiment of a vertical stabilizer illustrated in FIG. 7B.

DETAILED DESCRIPTION OF THE PREFERRED EMBODIMENTS OF THE INVENTION

Figure 1B:
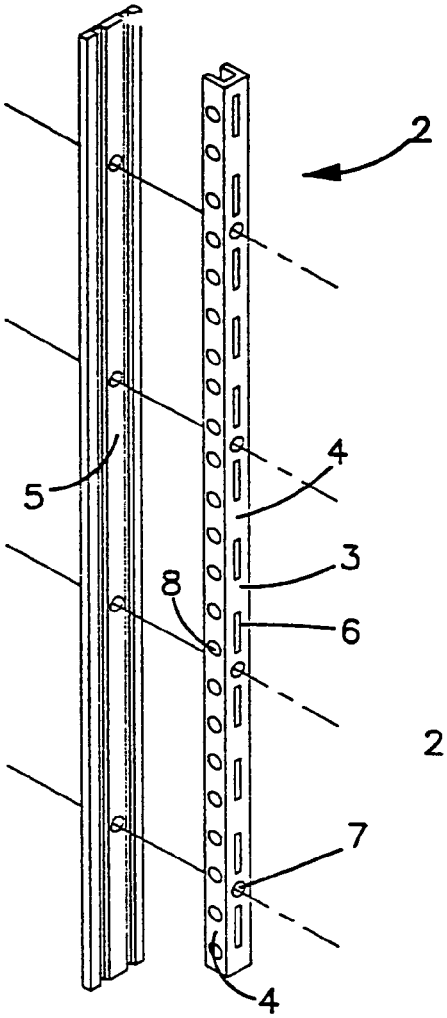
FIG. 1B is a perspective view of another preferred embodiment of a support strip having a separate back wall.
Figure 17A:
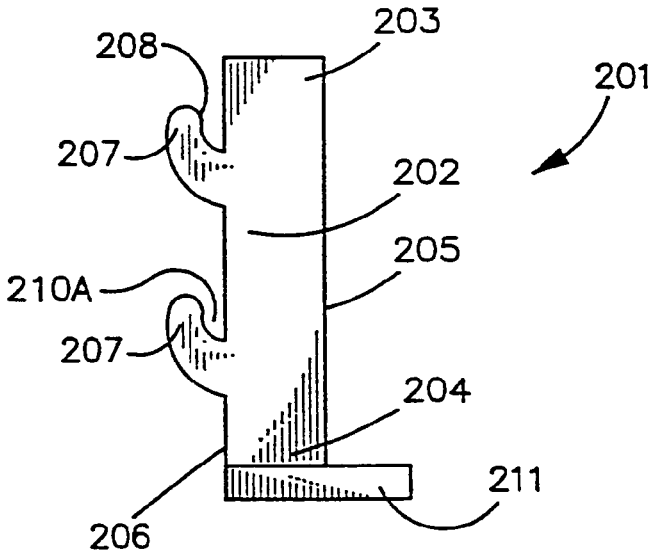
FIG. 17A is a side view of a preferred embodiment of a vertical brace.

A shelf bracket assembly 1 is disclosed. Shelf bracket assembly 1 comprises a plurality of vertical support strips 2. Support strips 2 are preferably provided with a face 3 and generally perpendicular sidewalls 4. For added strength, support strips 2 may also be provided with a back wall 5, opposite face 3. In one preferred embodiment, back wall 5 may be provided as separate piece from the rest of support strip 2, as illustrated in FIG. 1B. When this embodiment is used, back wall 5 preferably contains a pair of aligned grooves sized to receive the edges of sidewalls 4. Support strip 2 preferably contains a plurality of slots 6 in face 3. Slots 6 should be evenly spaced and vertically aligned. In one preferred embodiment (not shown) two parallel columns of slots 6 are provided in strips 2. When this embodiment is used, two columns of hook members 14 (described below) may be provided on shelf bracket 9 (also described below). Support strips 2 are also preferably provided with a plurality of attachment apertures 7 sized to receive a nail, a screw, a bolt, or other means for operatively attaching support strip 2 to a wall. Support strips 2 may also be provided with a plurality of strip apertures 8. Strip apertures 8 are preferably contained in sidewalls 4, and are preferably vertically aligned. Strip apertures 8 are preferably provided in each sidewall 4. The strip apertures 8 in each sidewall 4 should preferably be aligned with each other vertically and horizontally.

A plurality of shelf brackets 9 configured to engage support strips 2 are also provided. Shelf brackets 9 comprise a base 10 and a horizontal support member 11 fixedly attached to base 10. In one preferred embodiment, horizontal support member 11 is releasably attached to base 10. This is preferably accomplished by providing horizontal support member 11 with one or more hook members 14A (substantially similar to hooks 14, discussed below). In this embodiment, base 10 is provided with one or more apertures 400 sized to allow passage of hooks 14A. Thus, hooks 14A can pass through apertures 400 and engage support strip 2, securing horizontal support member 11 and base 10 to support strip 2. In another preferred embodiment, base 10 may be provided with independent hook members (substantially similar to hooks 14, discussed below). In this embodiment, hook members will engage support strip 2. Depending on their length, hook members 14A will either engage strip 2 as well or they may engage apertures 400 of base 10. In another preferred embodiment, base 10 and horizontal support member 11 may be provided with one or more pairs of snaps comprising a recess and a matching headed shaft to allow horizontal support member 11 to engage base 10 by inserting the headed shaft into the recess. The recess or the head or both should be deformable in order to allow the shaft to be inserted into and withdrawn from the recess.

Horizontal support member 11 should be of a size and strength to support at least half the weight of a shelf 18, including any reasonably expected load for the intended use of shelf 18. In most preferred embodiments, horizontal support member 11 will be between six and twenty-four inches in length. Base 10 has an upper end 12 and a lower end 13. Between upper end 12 and lower end 13 are hook members 14. Hook members 14 should be sized and positioned to lockingly fit within slots 6 in support strips 2. Hook members 14 should define a groove 15. Groove 15 should have an open mouth 16 and a closed end 17 opposite mouth 16. In one preferred embodiment, the width of groove 15 narrows from mouth 16 to closed end 17. This narrowing may be continuous, or it may occur in discrete steps. By having groove 15 vary in width, it may securely engage support strips 2 of differing thicknesses.

Base 10 should preferably be provided with a horizontal stabilizer 41. Horizontal stabilizer 41 is configured to contact the wall to which support strips 2 are mounted. Stabilizer 41 may comprise a right flange 42 and a left flange 43, each of which include a wall surface 44 configured and sized to contact the wall and a strip surface 45 configured to contact strip 2 when bracket 9 is mounted on support strip 2. Flanges 42 and 43 of horizontal stabilizer 41 thereby operate to form a channel 46 under which support strip 2 resides when shelf bracket 9 is attached to support strip 2. Wall surfaces 44 of horizontal stabilizer 41 brace bracket 9 against the wall, thereby resisting horizontal displacement of bracket 9 or shelf 18.

Shelf 18 has a first end 19, and a second end 20. Base 10 should be provided with a recess 21 sized to receive first end 19 of shelf 18. Recess 21 may be sized to provide a tight fit for first end 19 of shelf 18. Alternatively, a shim 22 may be provided to fill any extra space in recess 21 when shelf 18 is in place. Shim 22 and base 10 may be provided with a tongue and groove interlocking mechanism 23 so that shim 22 may engage base 10 when it is in place. A tongue and groove interlocking mechanism 23A may also be provided between shelf 18 and base 10 or between shelf 18 and shim 22.

When recess 21 is sized to provide a tight fit for first end 19 without shim 22, first end 19 may be provided with a rounded edge 29. Rounded edge 29 should face support member 11. In this embodiment, shelf 18 should be positioned at an angle to support member 11 with first end 19 in recess 21. Shelf 18 may be rotated on rounded edge 29 until shelf 18 is parallel to and rests against support member 11 across the length of support member 11.

Figure 5A:
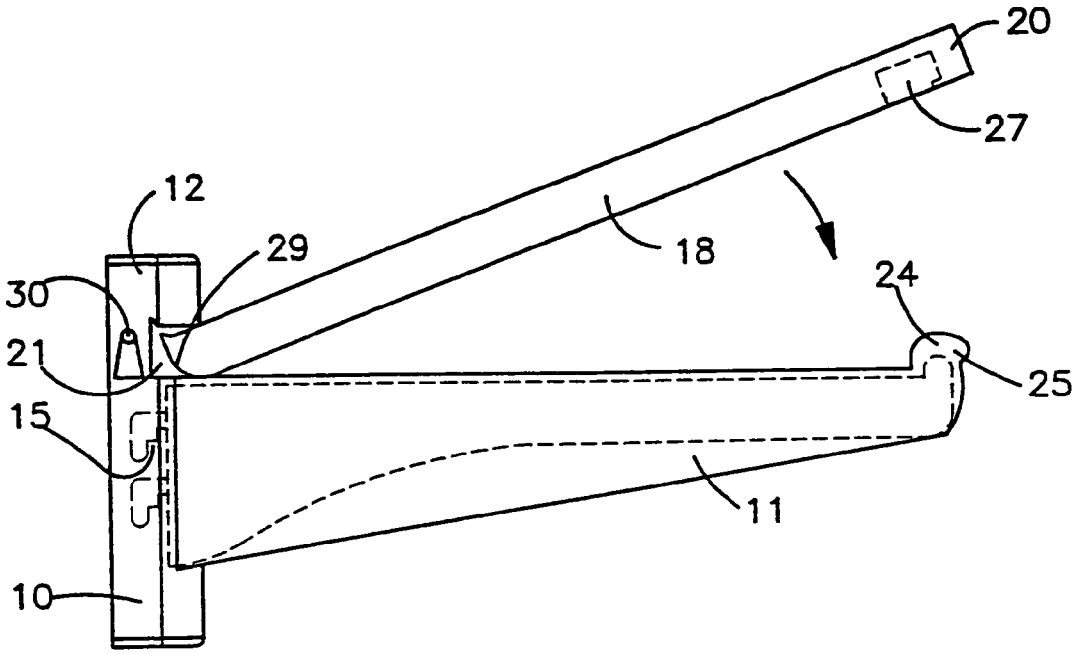
FIG. 5A is a side view of a preferred embodiment of a shelf with a rounded edge during installation into a preferred embodiment of a shelf bracket assembly.
Figure 5B:
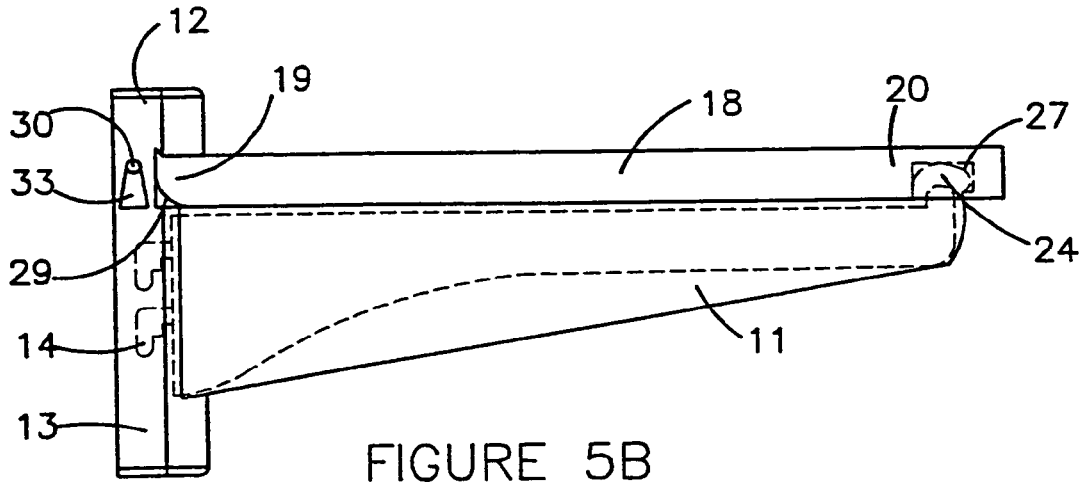
FIG. 5B is a side view of a preferred embodiment of a shelf with a rounded edge after having been installed into a preferred embodiment of a shelf bracket assembly.
Figure 5C:
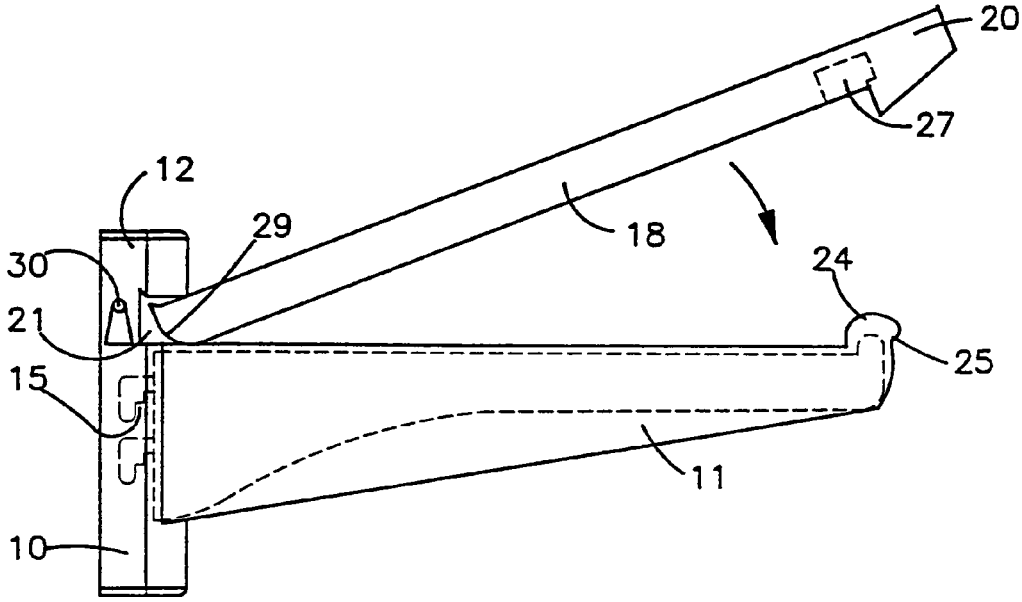
FIG. 5C is a side view of a preferred embodiment of a shelf with a rounded edge and an enlarged second end during installation into a preferred embodiment of a shelf bracket assembly.
Figure 5D:
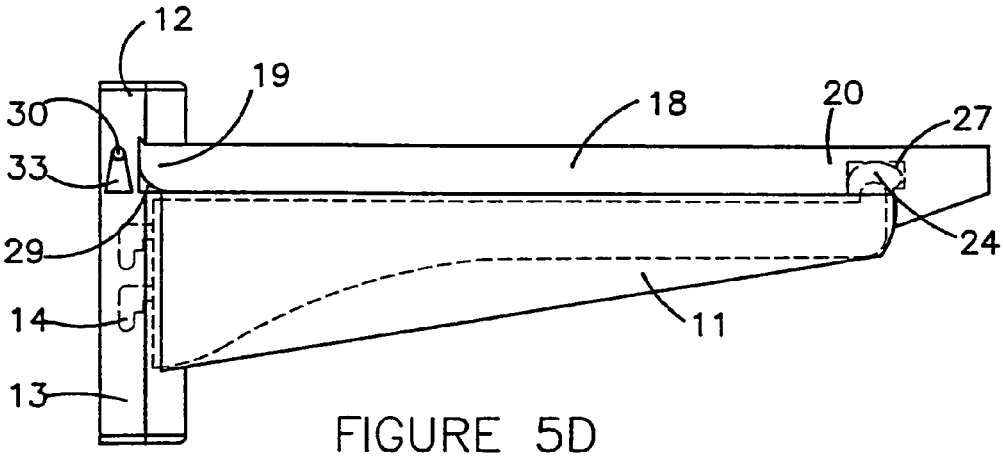
FIG. 5D is a side view of a preferred embodiment of a shelf with a rounded edge and an enlarged second end after having been installed into a preferred embodiment of a shelf bracket assembly.
Figure 6B:
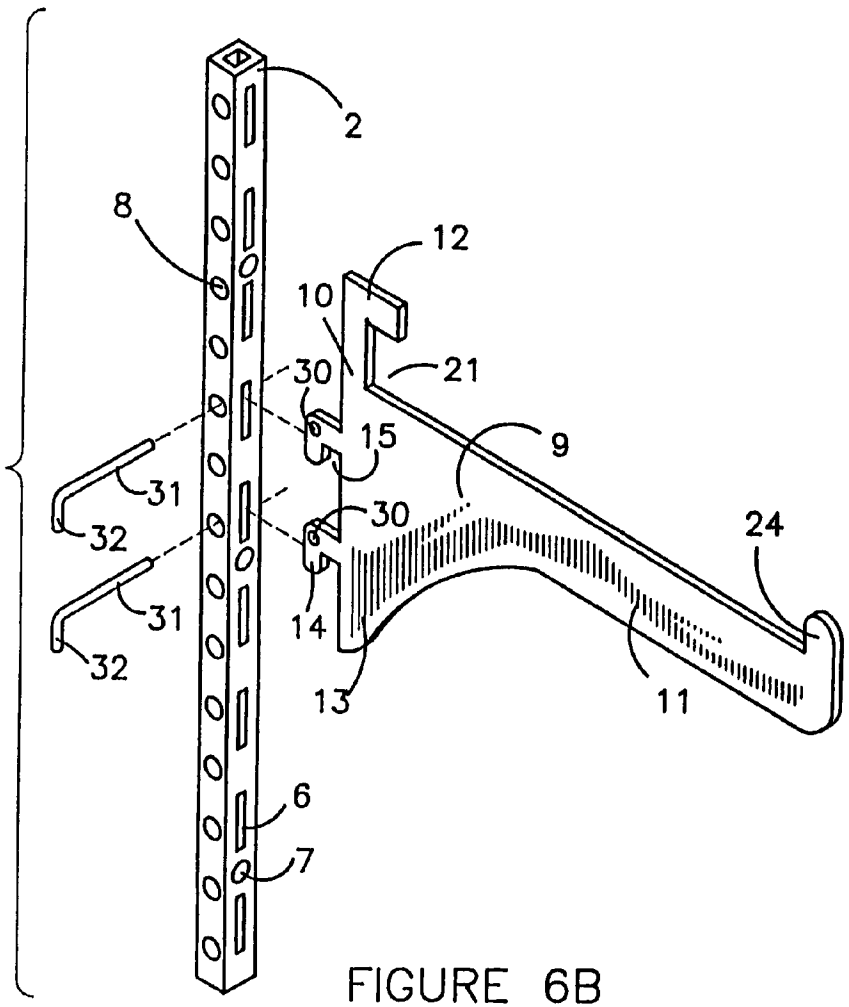
FIG. 6B is an exploded view of another preferred embodiment of a locking pin and another preferred embodiment of a shelf bracket assembly.
Figure 6A:
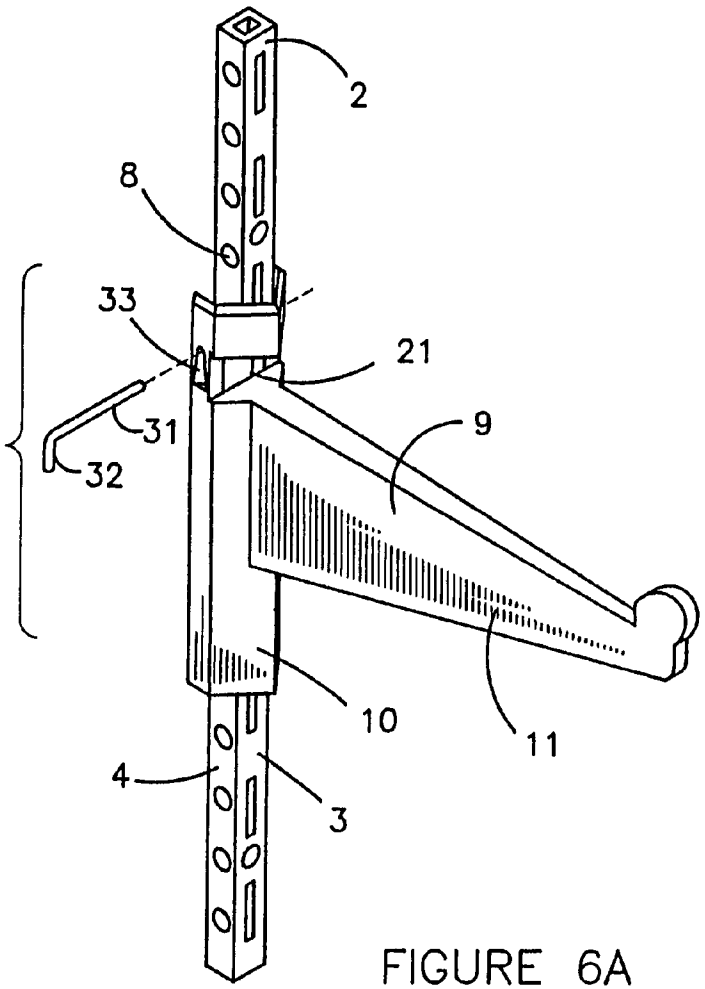
FIG. 6A is an exploded view of a preferred embodiment of a locking pin and a preferred embodiment of a shelf bracket assembly.
Figure 8B:
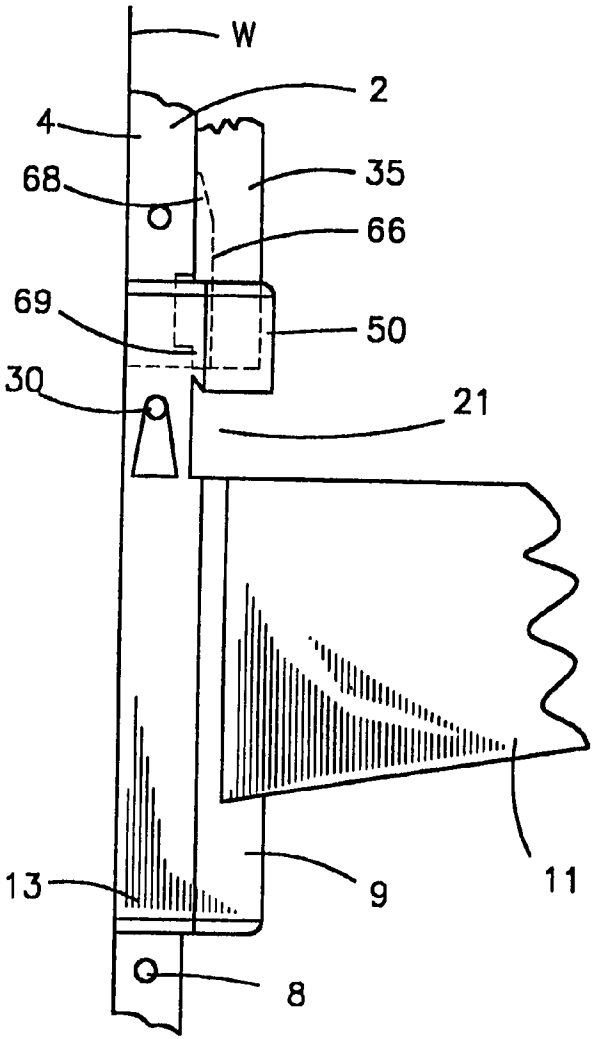
FIG. 8B is the same view shown in FIG. 8A, but with a preferred embodiment of a divider section in place over the vertical stabilizer.
Figure 8A:
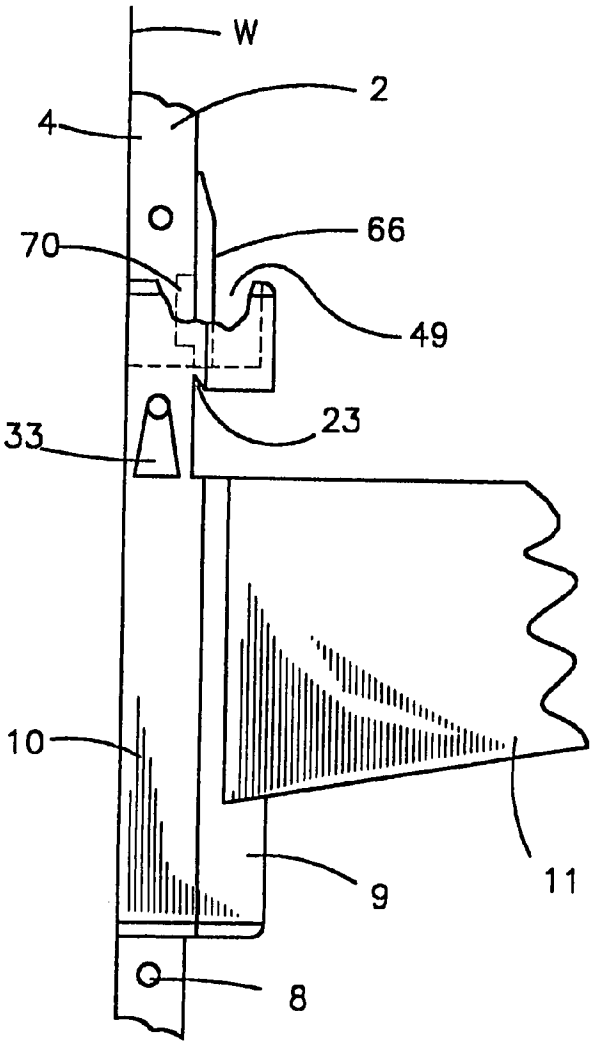
FIG. 8A is a side view of a preferred embodiment of a vertical stabilizer in position over a preferred embodiment of a shelf bracket.
Figure 9:
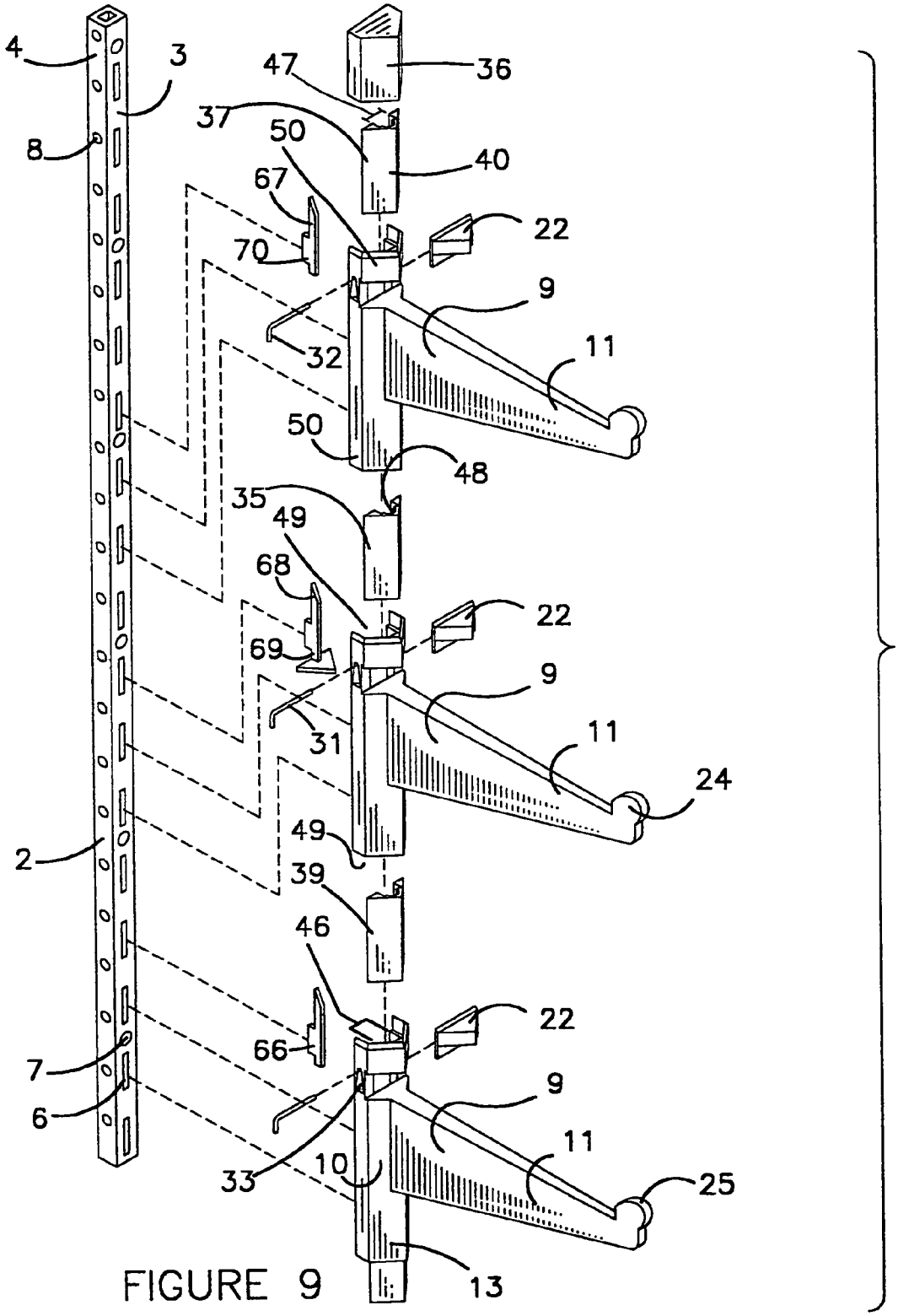
FIG. 9 is an exploded perspective view of a preferred embodiment of a shelf bracket assembly without the shelves.
Figure 10:
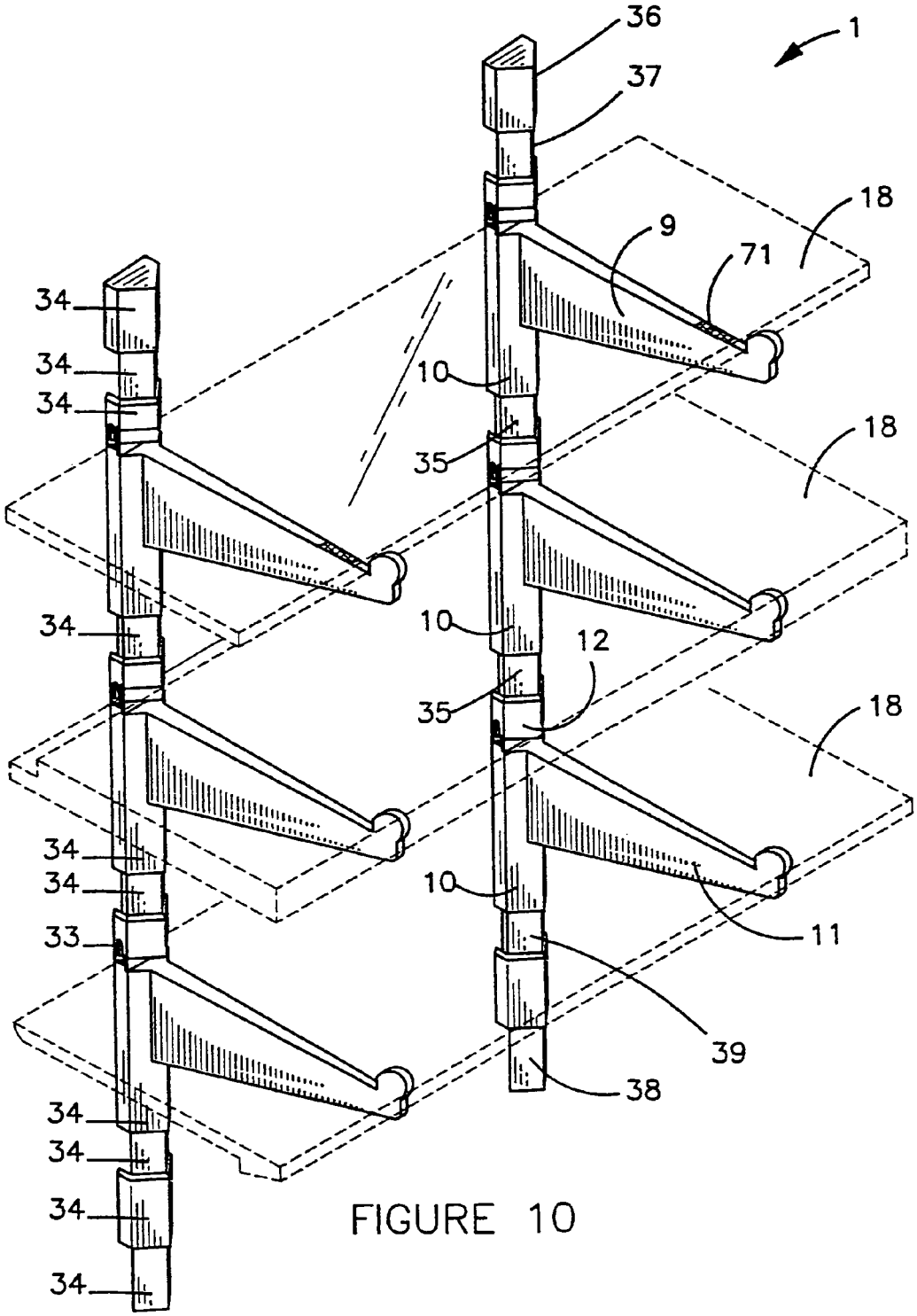
FIG. 10 is a perspective view of a preferred embodiment of a fully assembled shelf bracket assembly.
Figure 12:
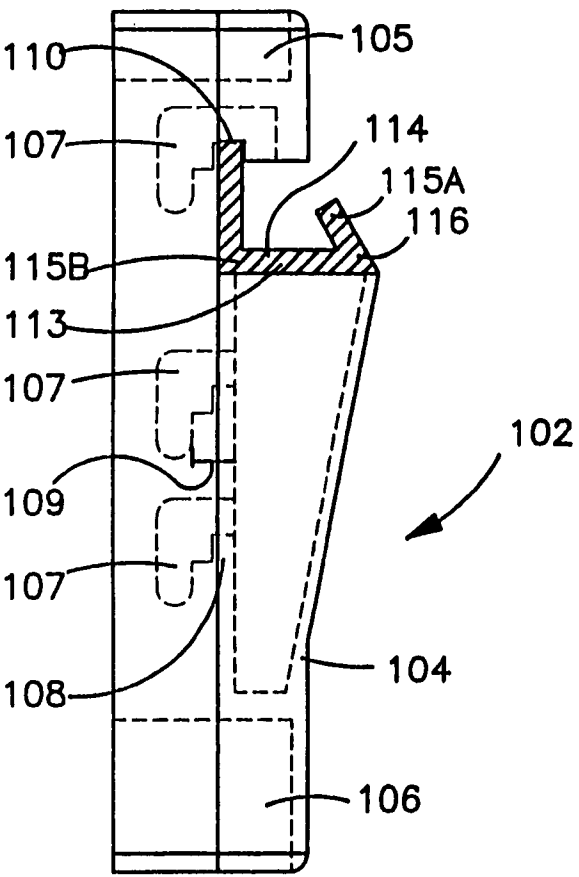
FIG. 12 is a side view of another preferred embodiment of a cabinet support member.
Figure 11:
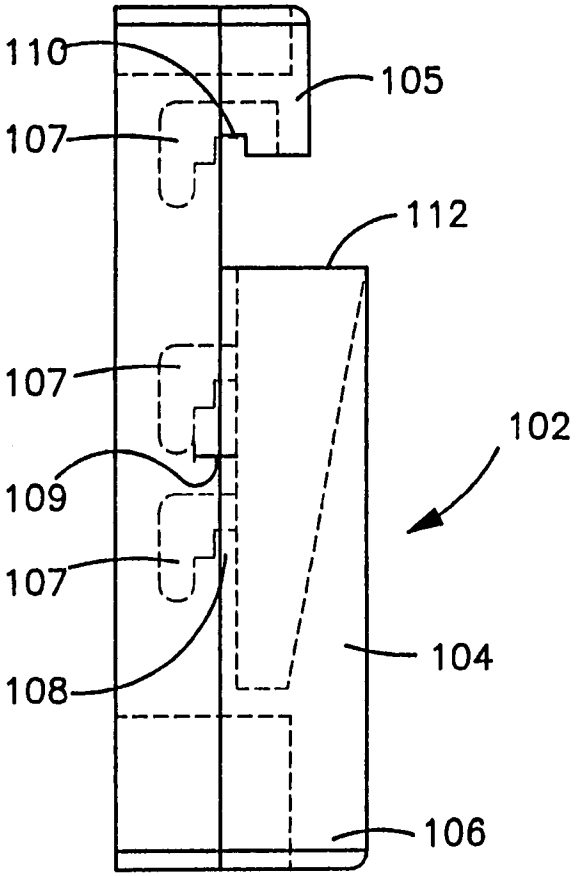
FIG. 11 is a side view of a preferred embodiment of a cabinet support member.
Figure 13:
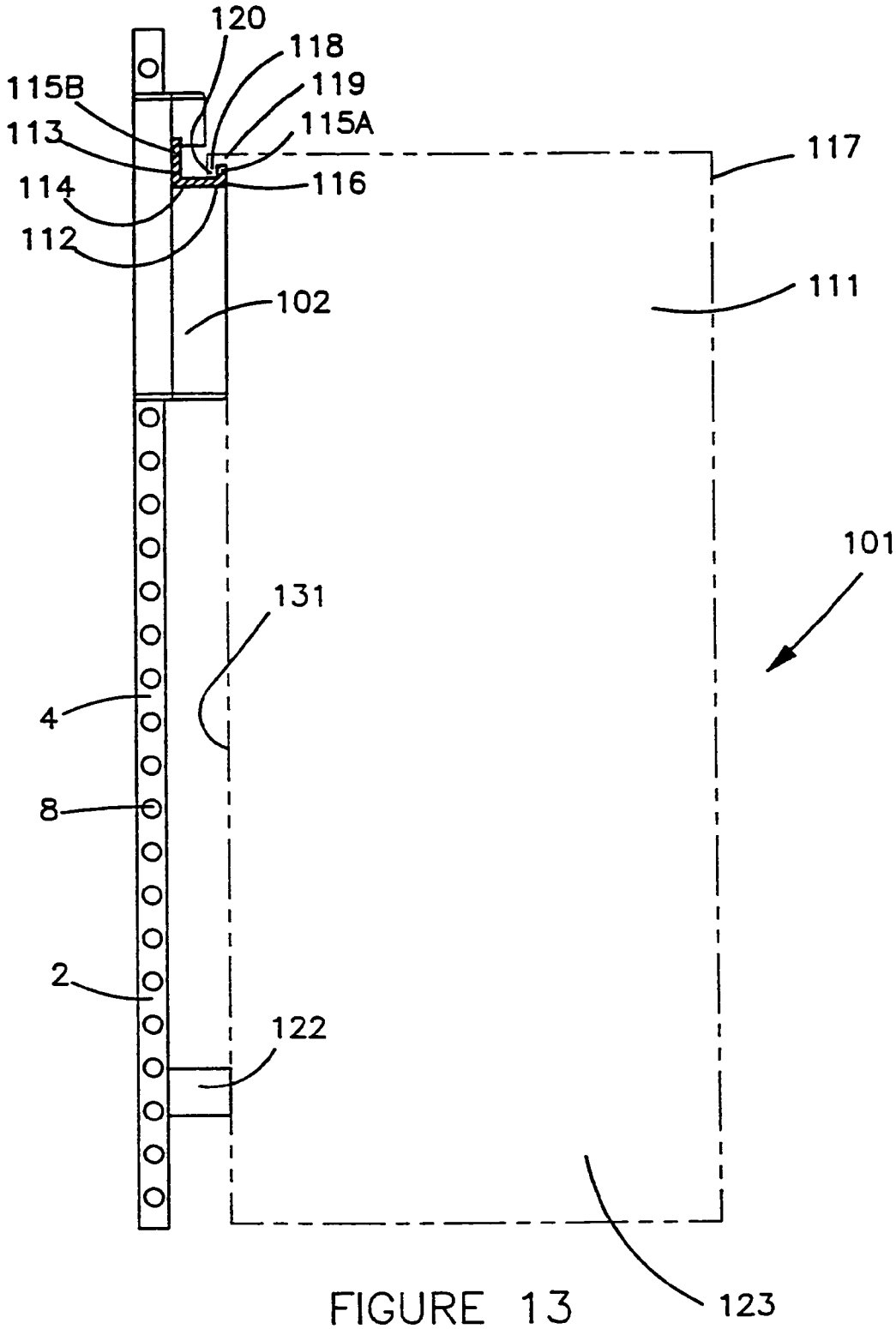
FIG. 13 is a side view of one preferred embodiment of a cabinetry assembly.
Figure 14:
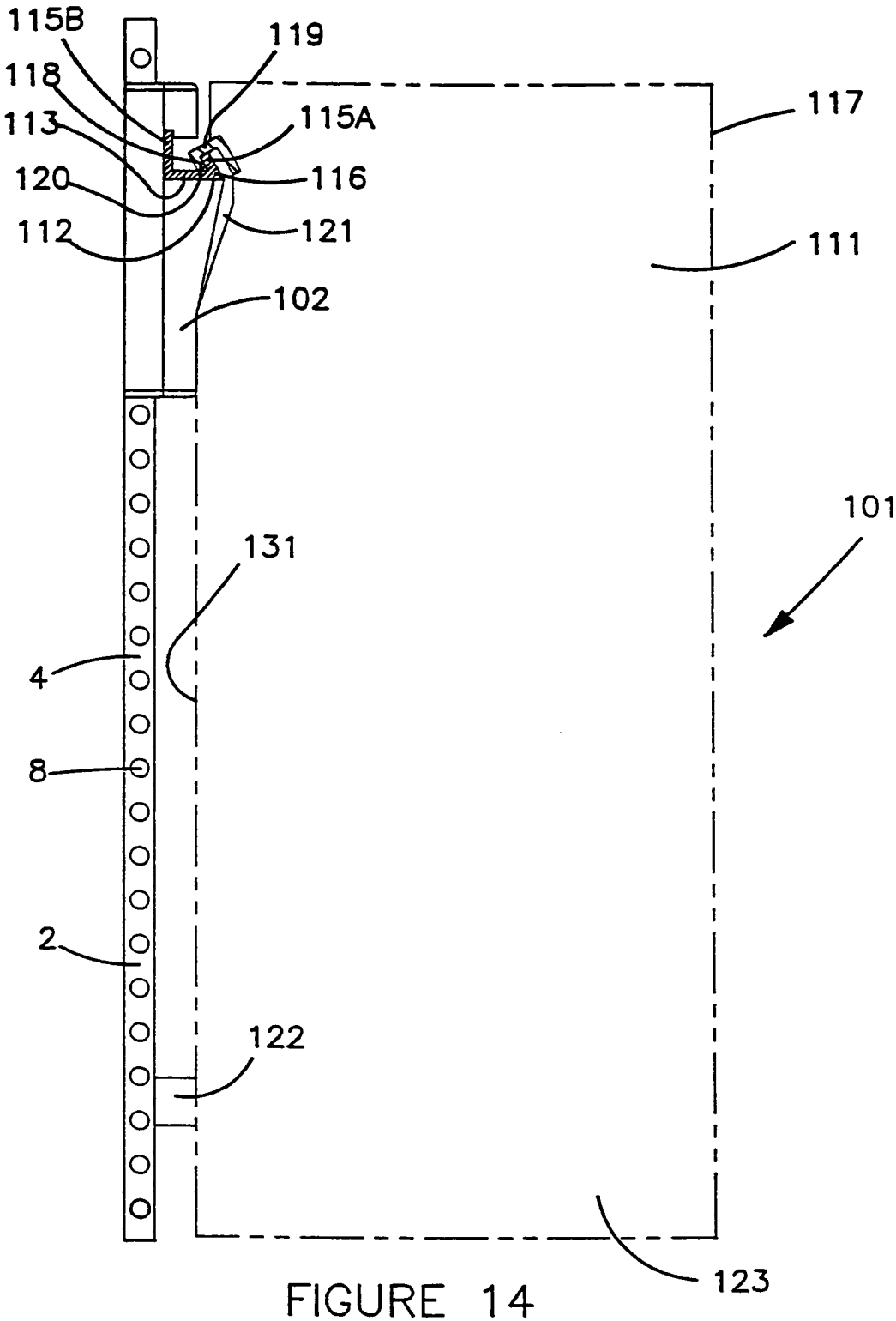
FIG. 14 is a side view of another preferred embodiment of a cabinetry assembly.
Figure 15:
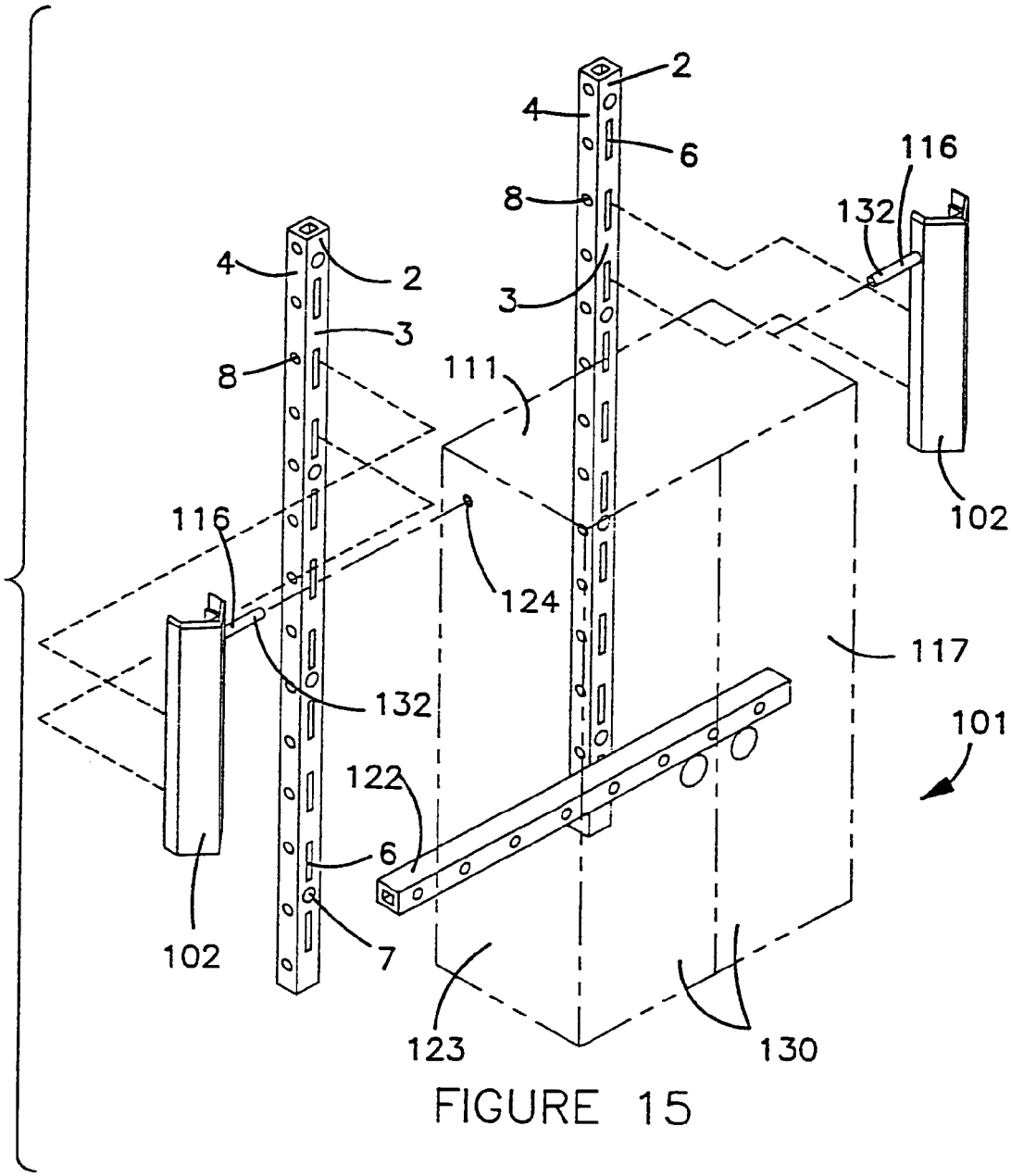
FIG. 15 is an exploded view of a preferred embodiment of a cabinetry assembly.
Figure 16:
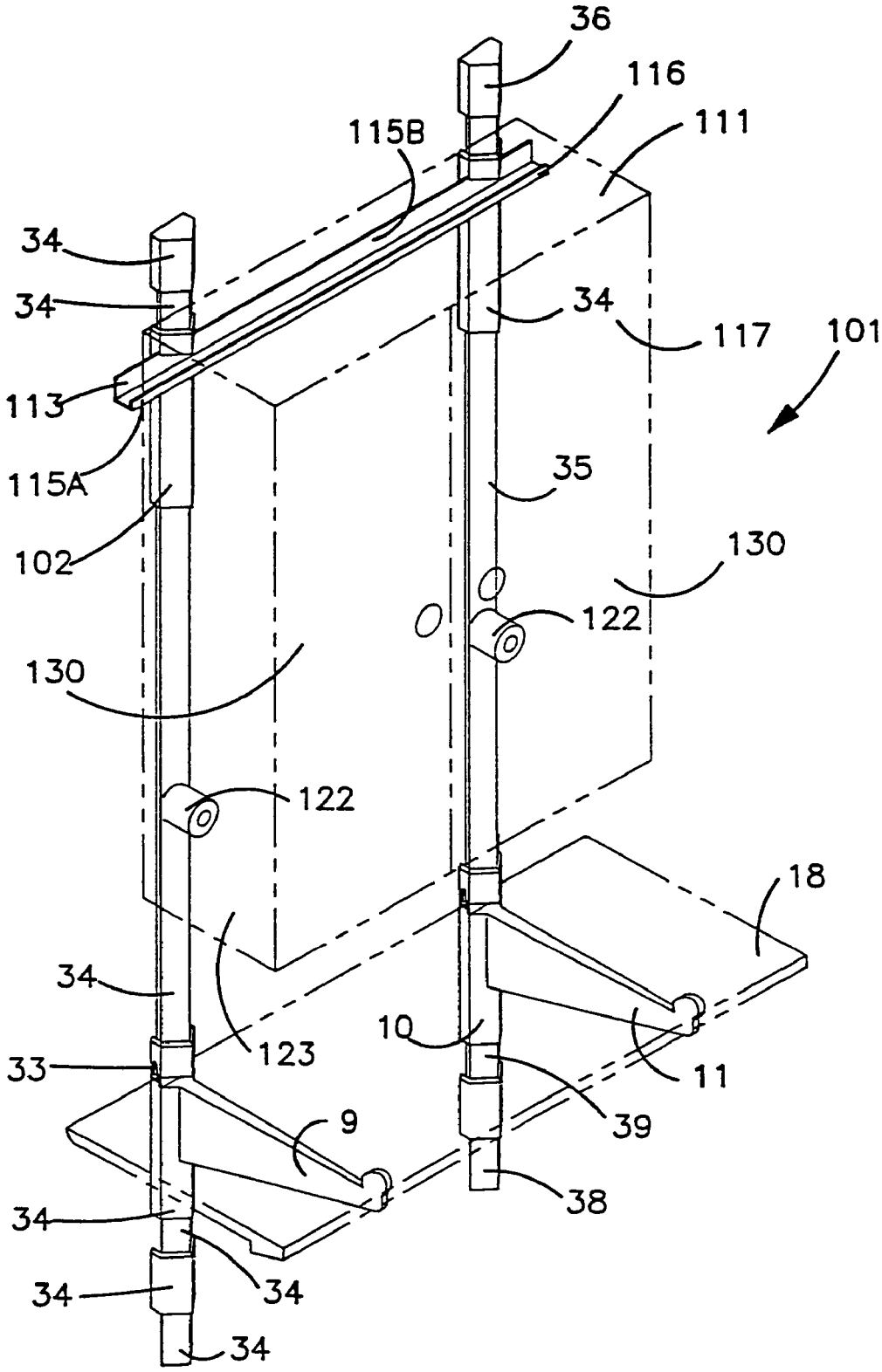
FIG. 16 is a perspective view of a preferred embodiment of a cabinetry assembly used with a shelf bracket assembly.
Figure 17B:
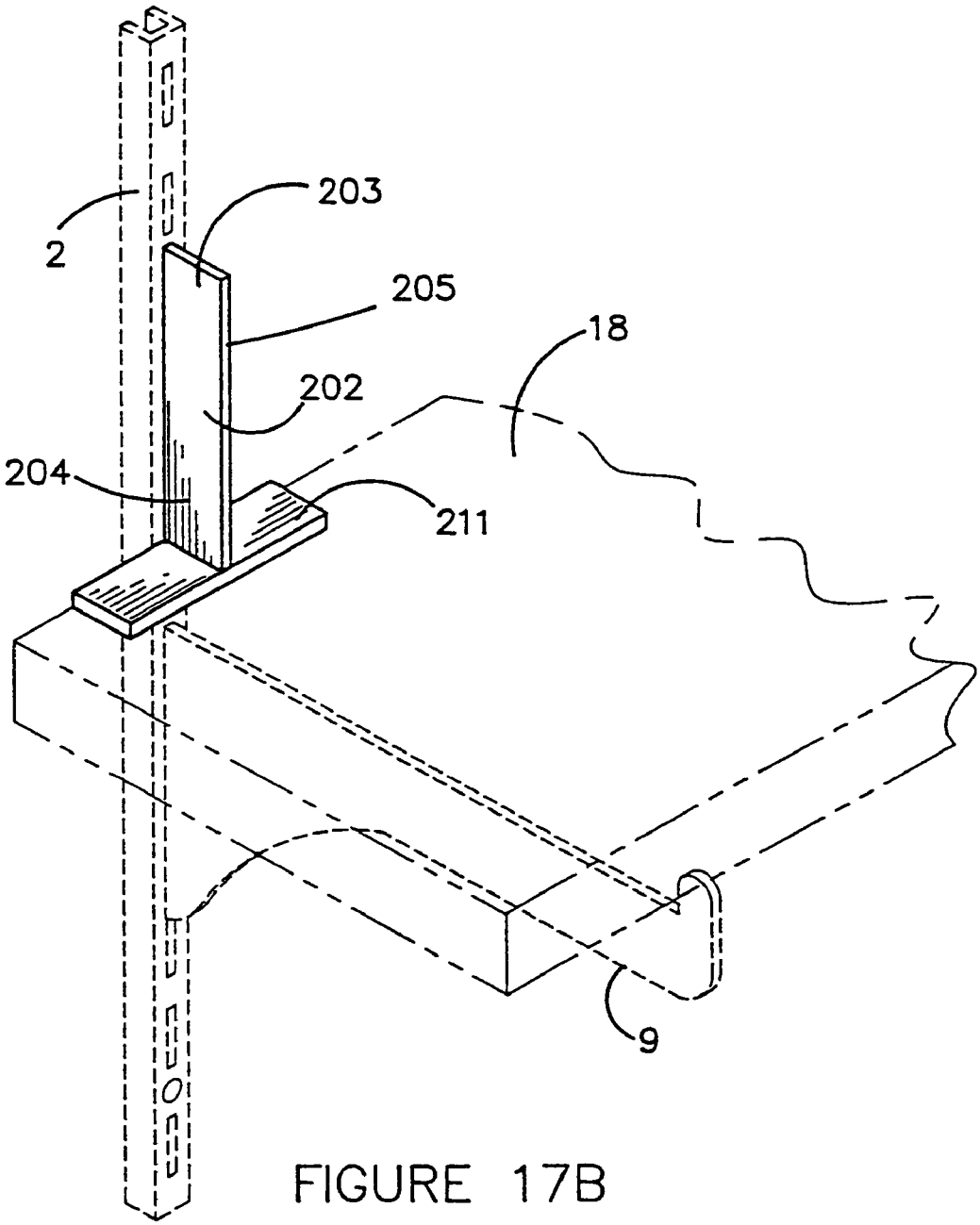
FIG. 17B is a perspective view showing a preferred embodiment of a vertical brace in use.
Figure 18:
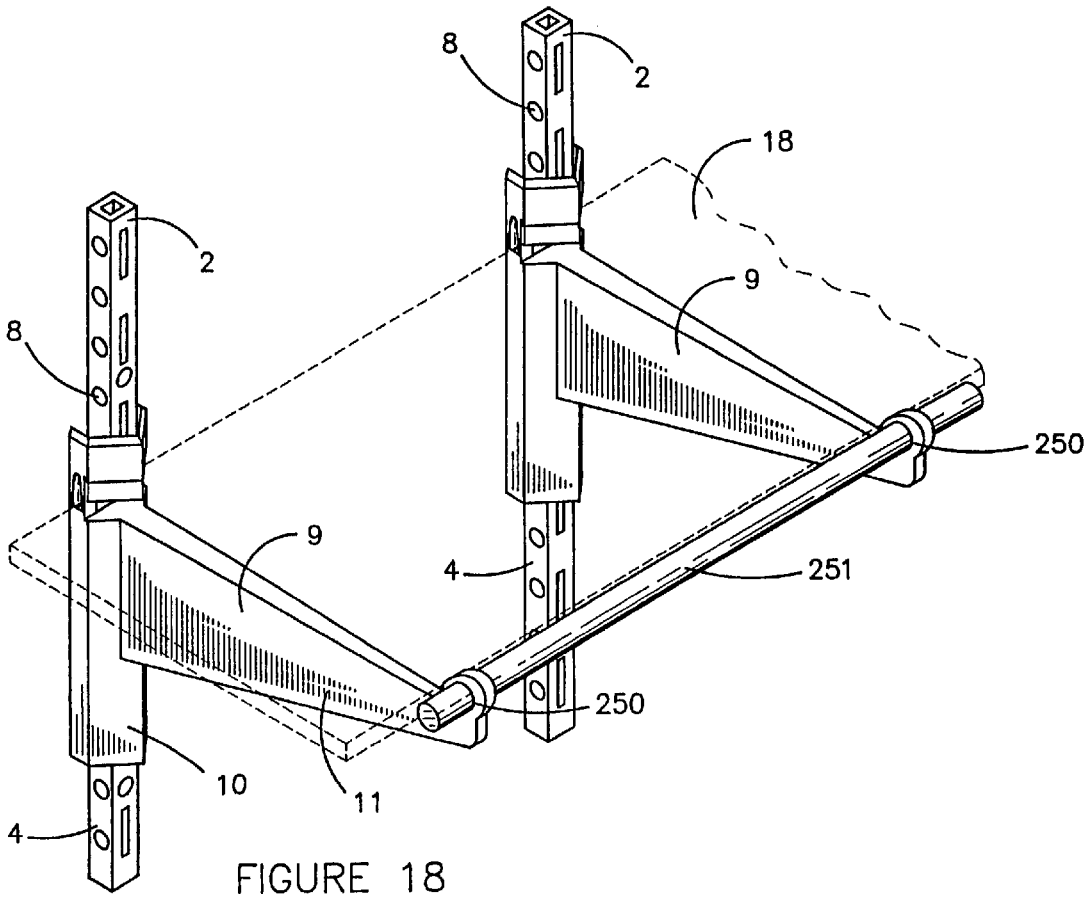
FIG. 18 is a perspective view of a pair of brackets having closet rod apertures and a closet rod.
Figure 20:
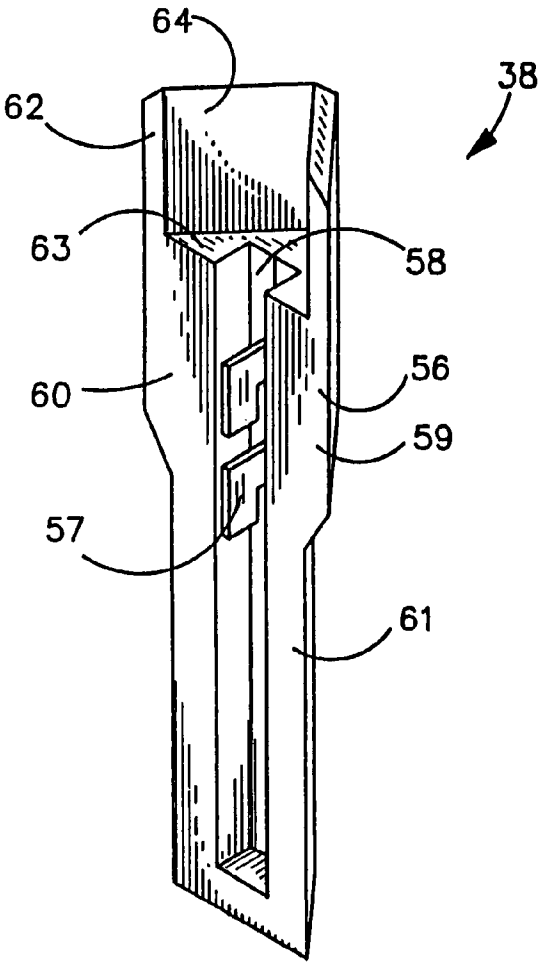
FIG. 20 is a perspective view of a preferred embodiment of a bottom section.
Figure 19:
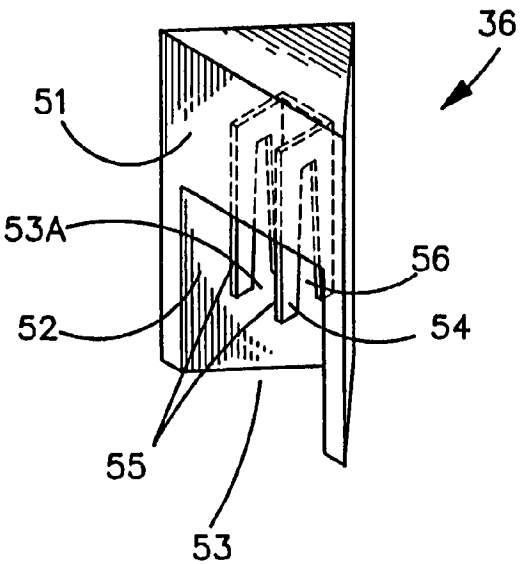
FIG. 19 is perspective view of a preferred embodiment of a cap section.
Figure 21:
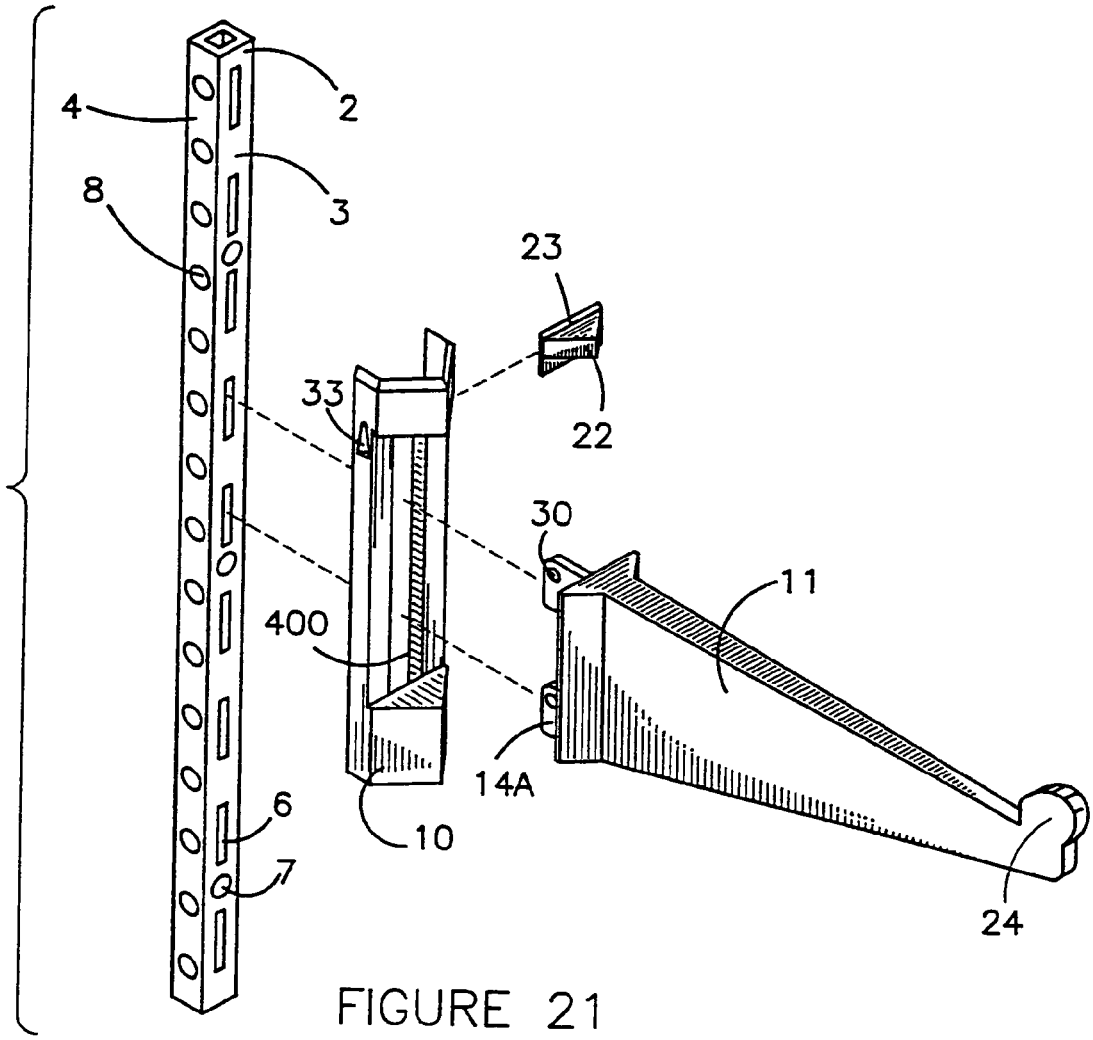
FIG. 21 is an exploded view of one preferred embodiment of a shelf bracket having a releasably connectable horizontal support member.
Figure 25:
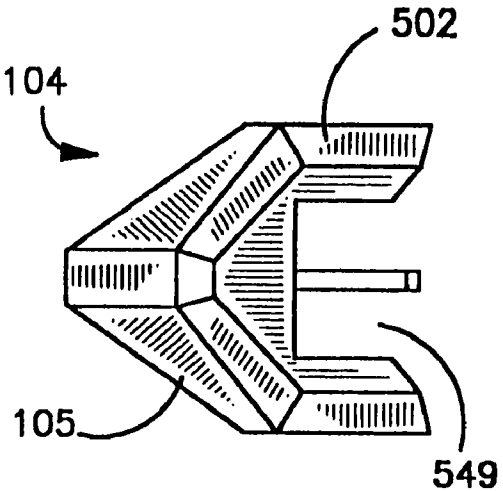
FIG. 25 is a top view of a preferred embodiment of a base having a cap for a preferred cabinetry assembly.
Figure 22:
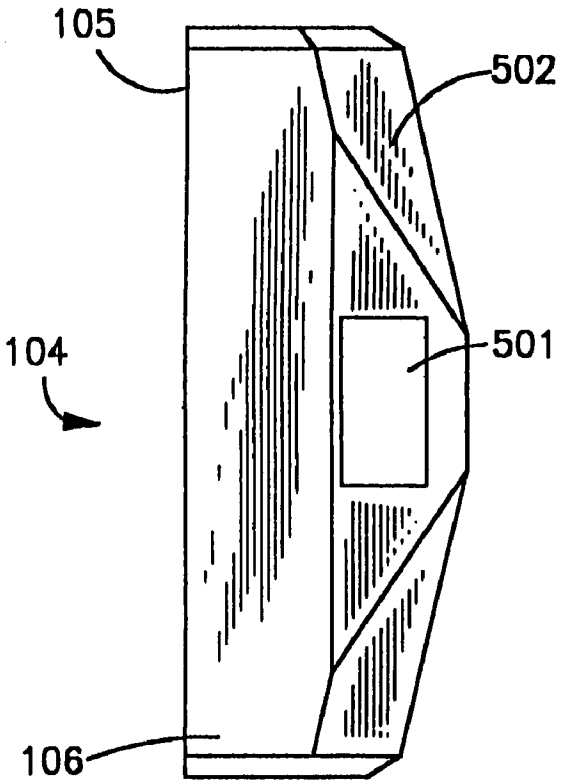
FIG. 22 is a side view of a preferred embodiment of a base having a cap for a preferred cabinetry assembly.
Figure 26:
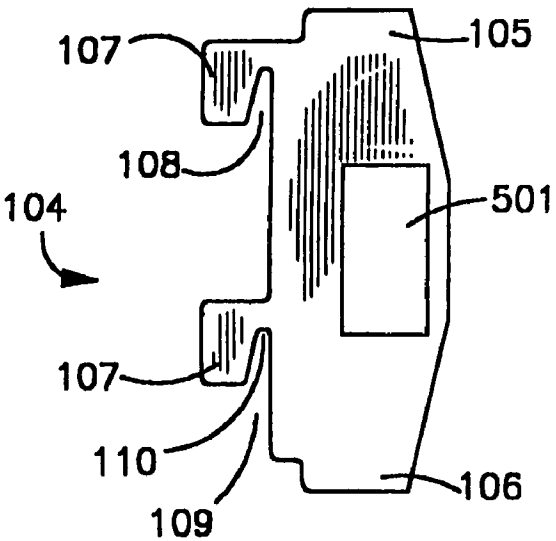
FIG. 26 is a side view of a preferred embodiment of a base for a preferred cabinetry assembly.
Figure 23:
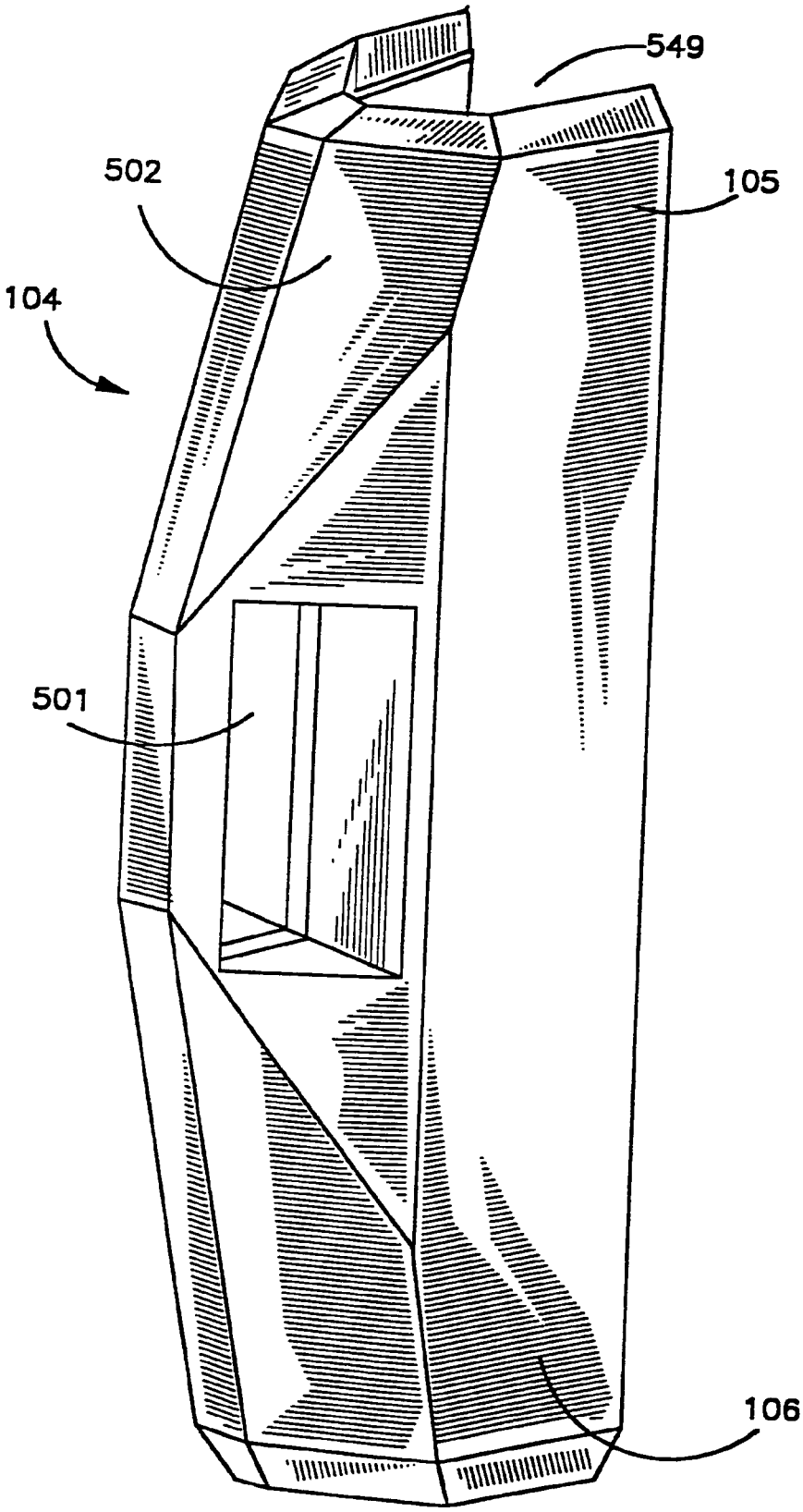
FIG. 23 is a front perspective view of a preferred embodiment of a base having a cap for a preferred cabinetry assembly.
Figure 24:
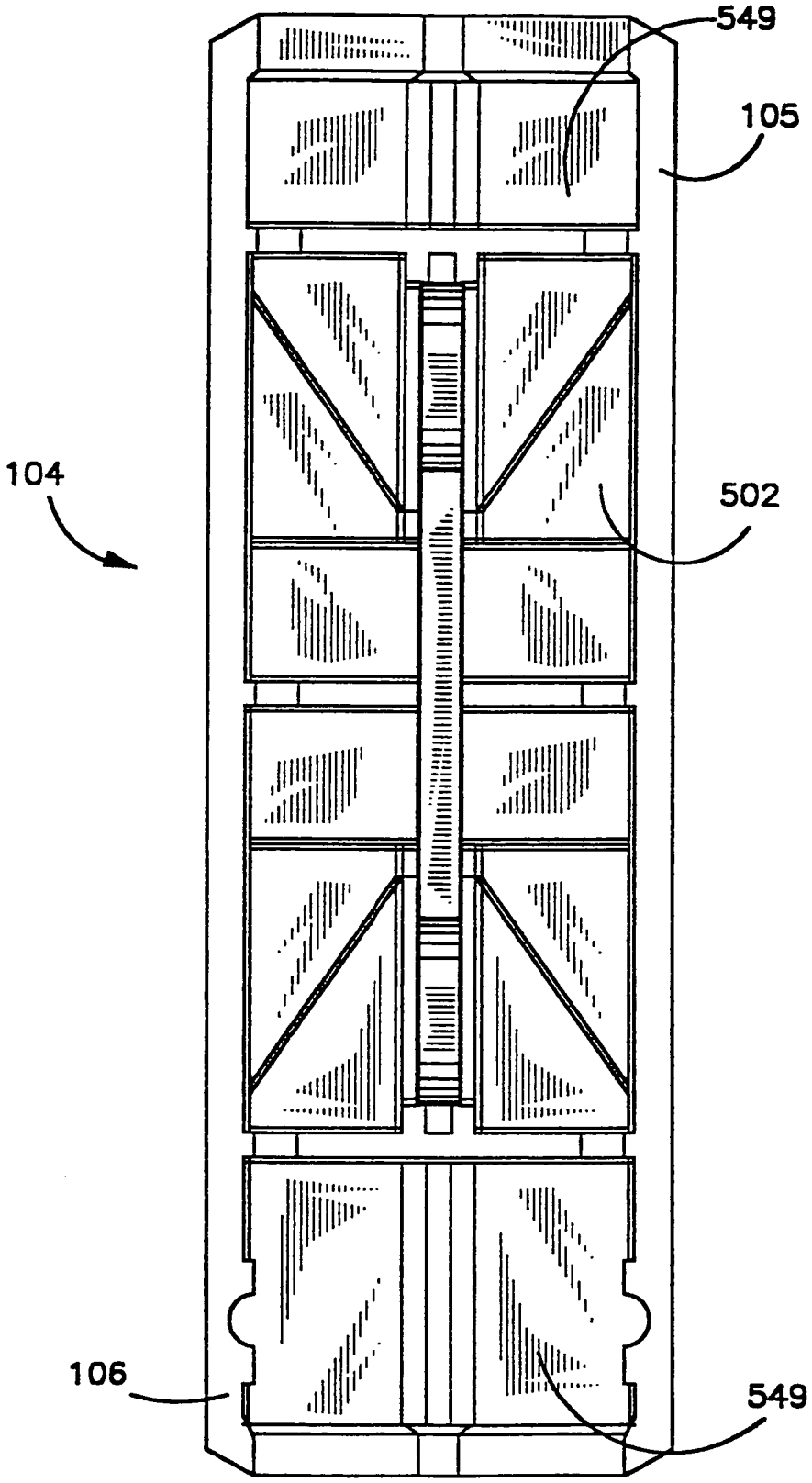
FIG. 24 is a rear view of a preferred embodiment of a base having a cap for a preferred cabinetry assembly.
Figure 27:
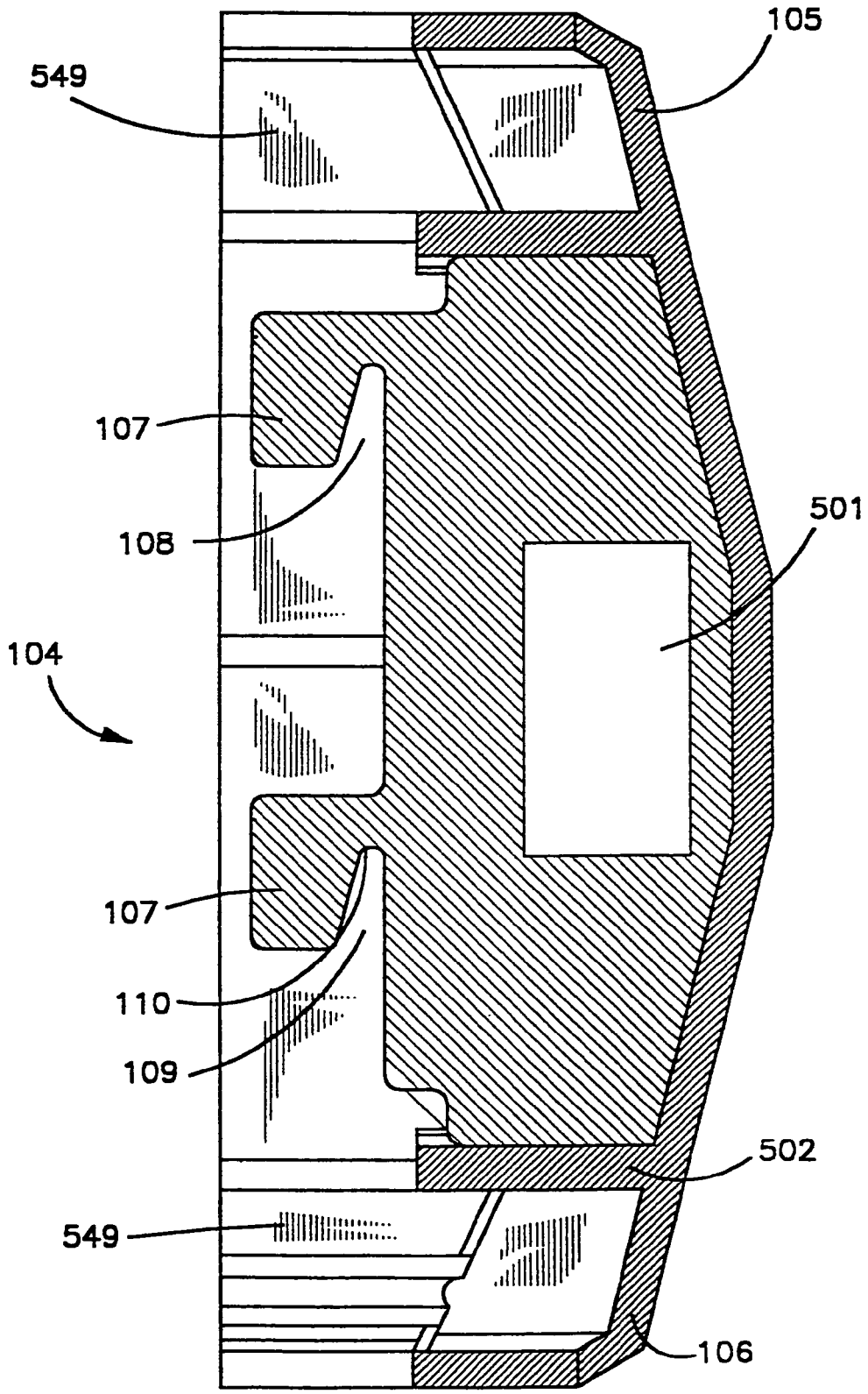
FIG. 27 is a cut away side view of a base having a cap for a preferred cabinetry assembly.
Figure 28:
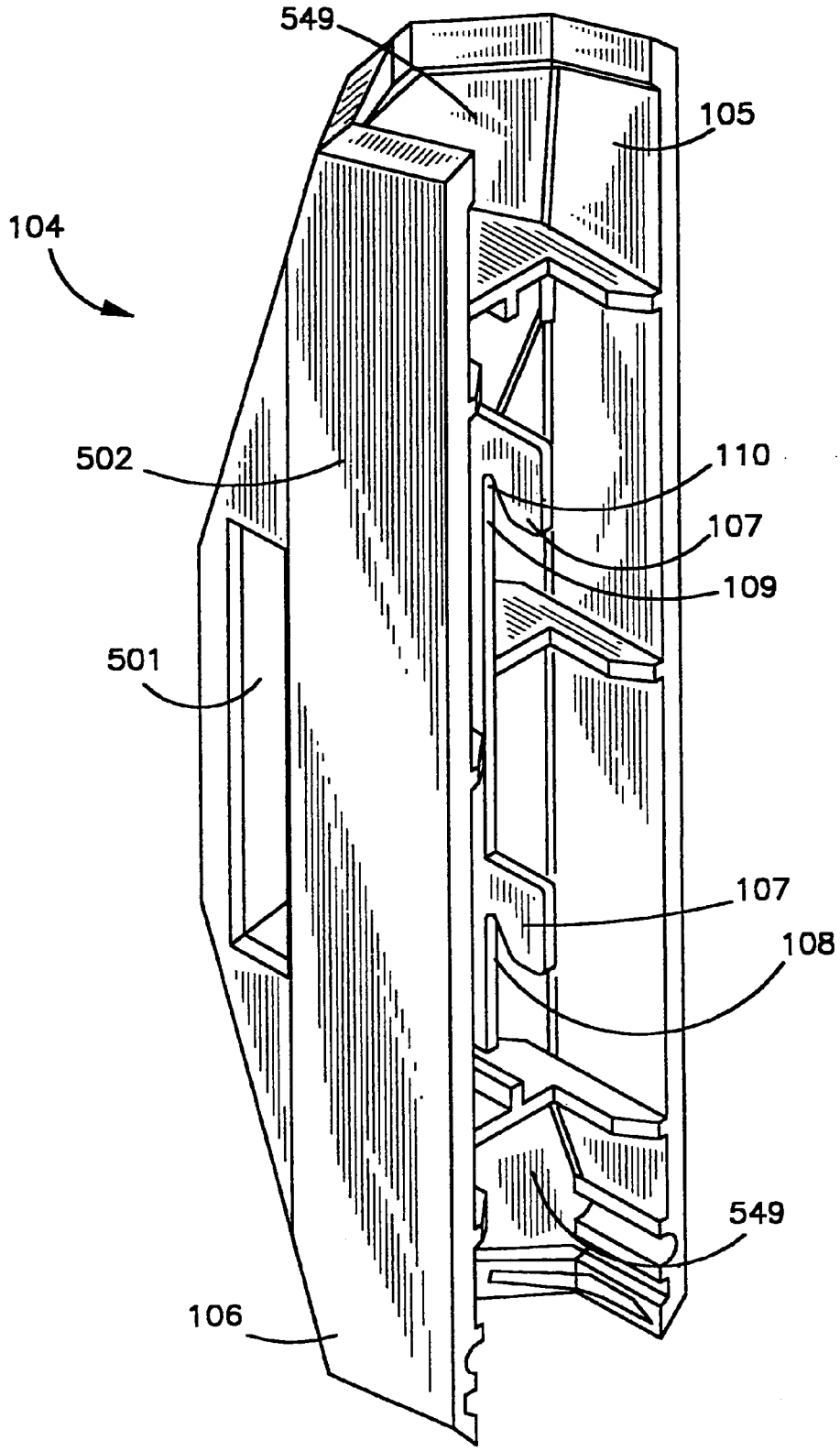
FIG. 28 is a rear perspective view of a preferred embodiment of a base having a cap for a preferred cabinetry assembly.
Figure 29:
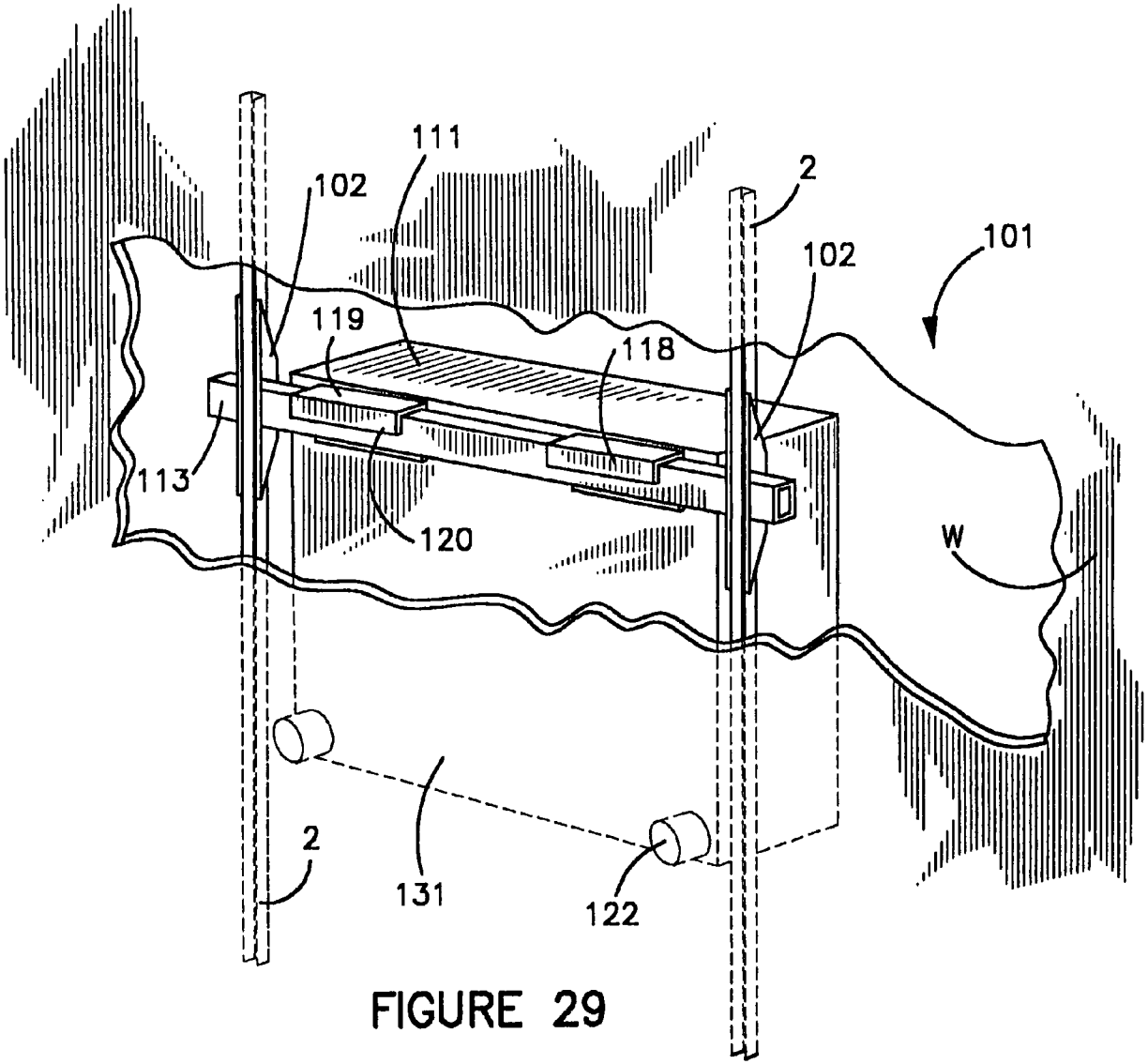
FIG. 29 is rear perspective view of preferred cabinetry assembly.
Figure 30:
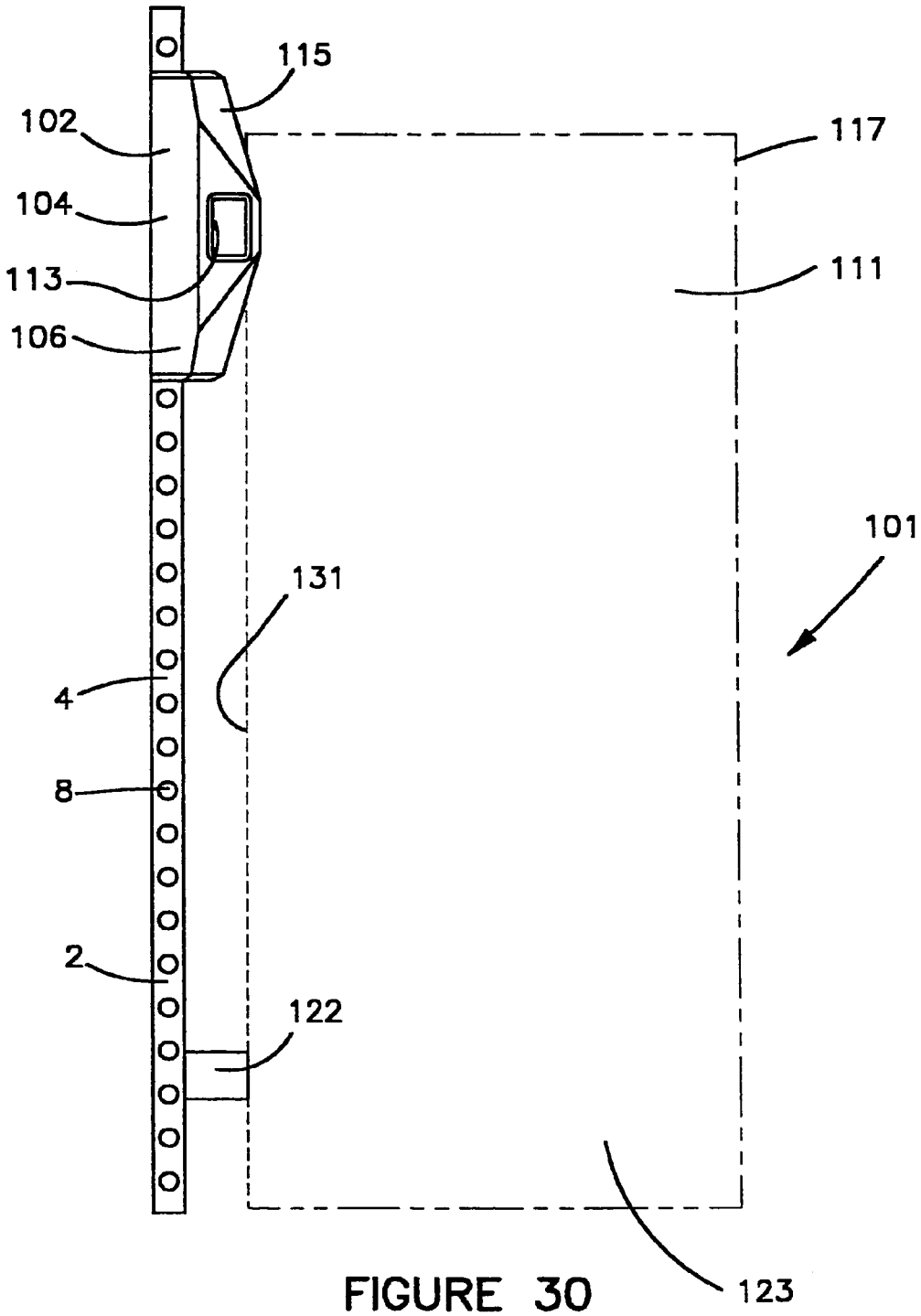
FIG. 30 is a side view of a preferred cabinetry assembly
Figure 31:
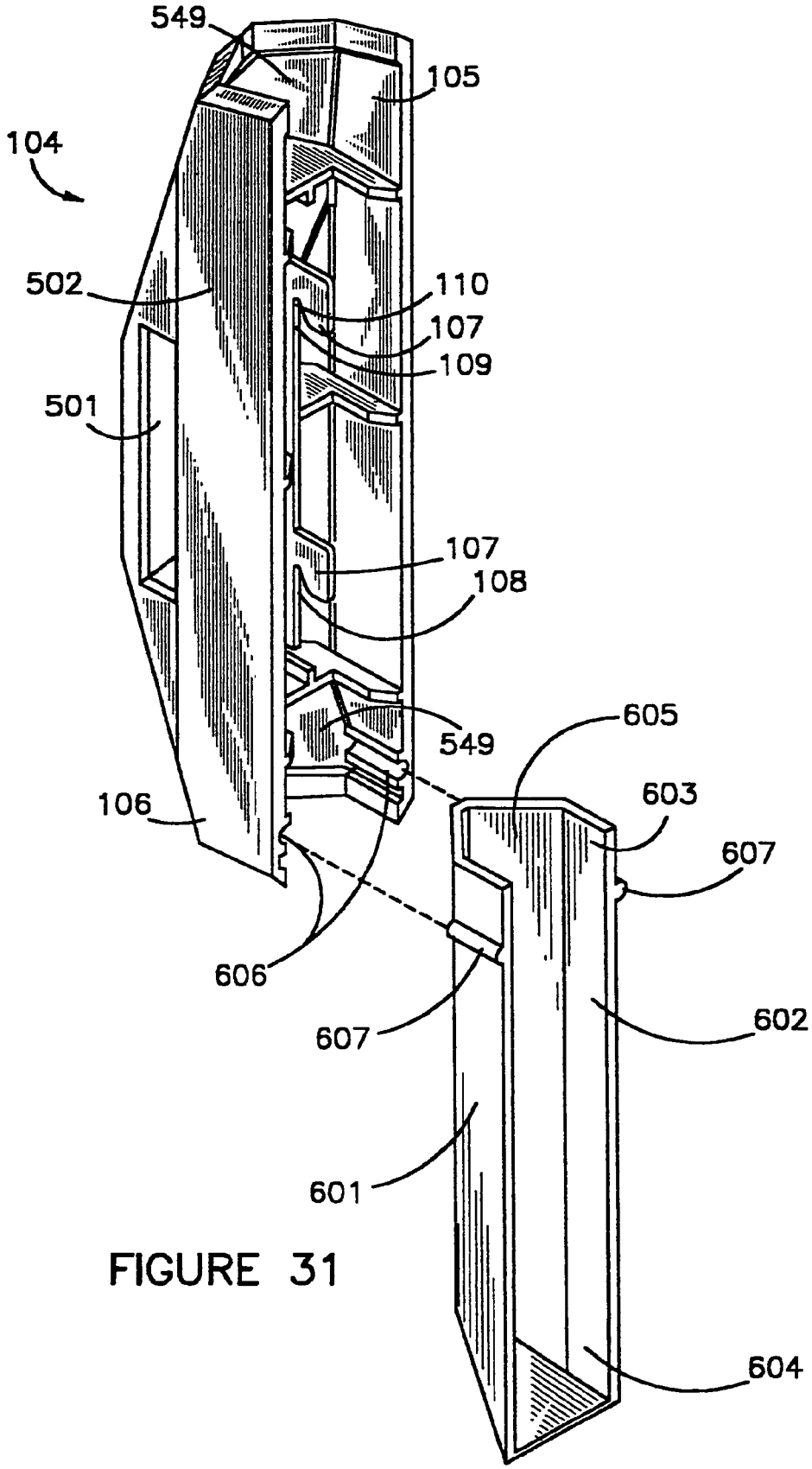
FIG. 31 is a rear perspective blow up view of a preferred embodiment of a base having a cap for a preferred cabinetry assembly and a preferred hanging casing.
Figure 32:
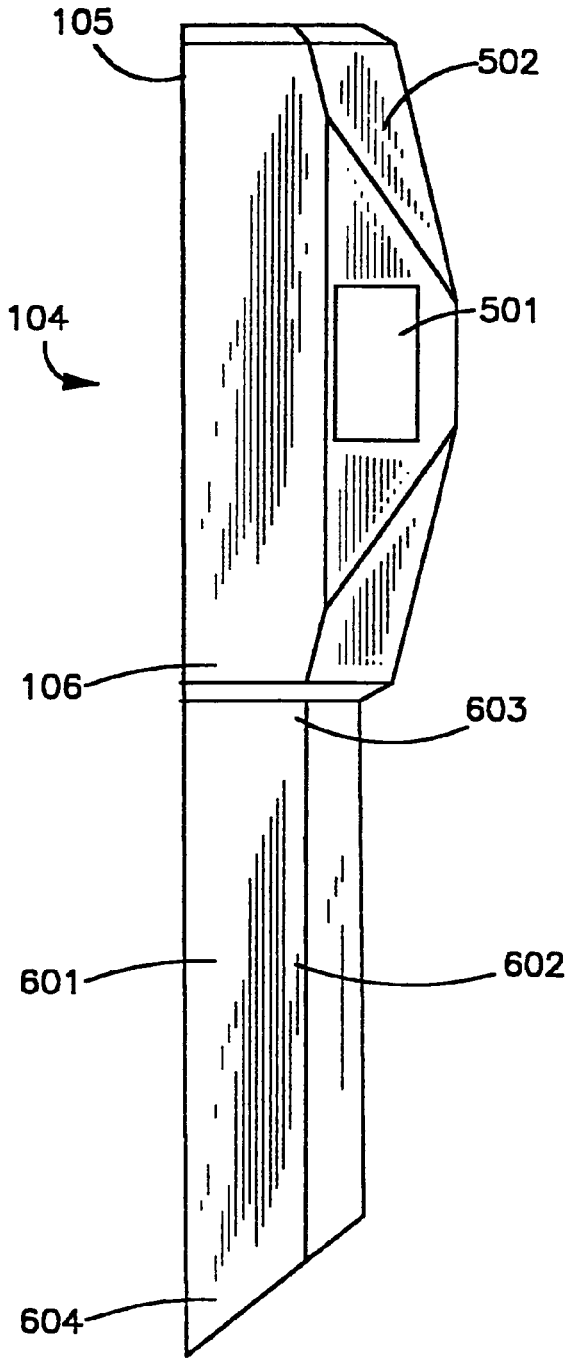
FIG. 32 is a side view of a preferred embodiment of a base having a cap for a preferred cabinetry assembly and a preferred hanging casing.
Figure 34:
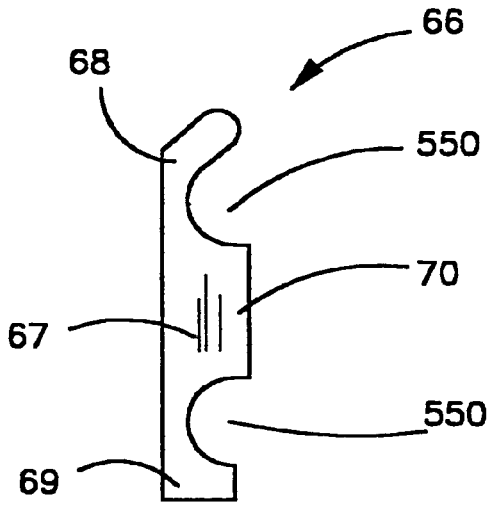
FIG. 34 is a side view of a preferred embodiment of a vertical stabilizer.
Figure 33:
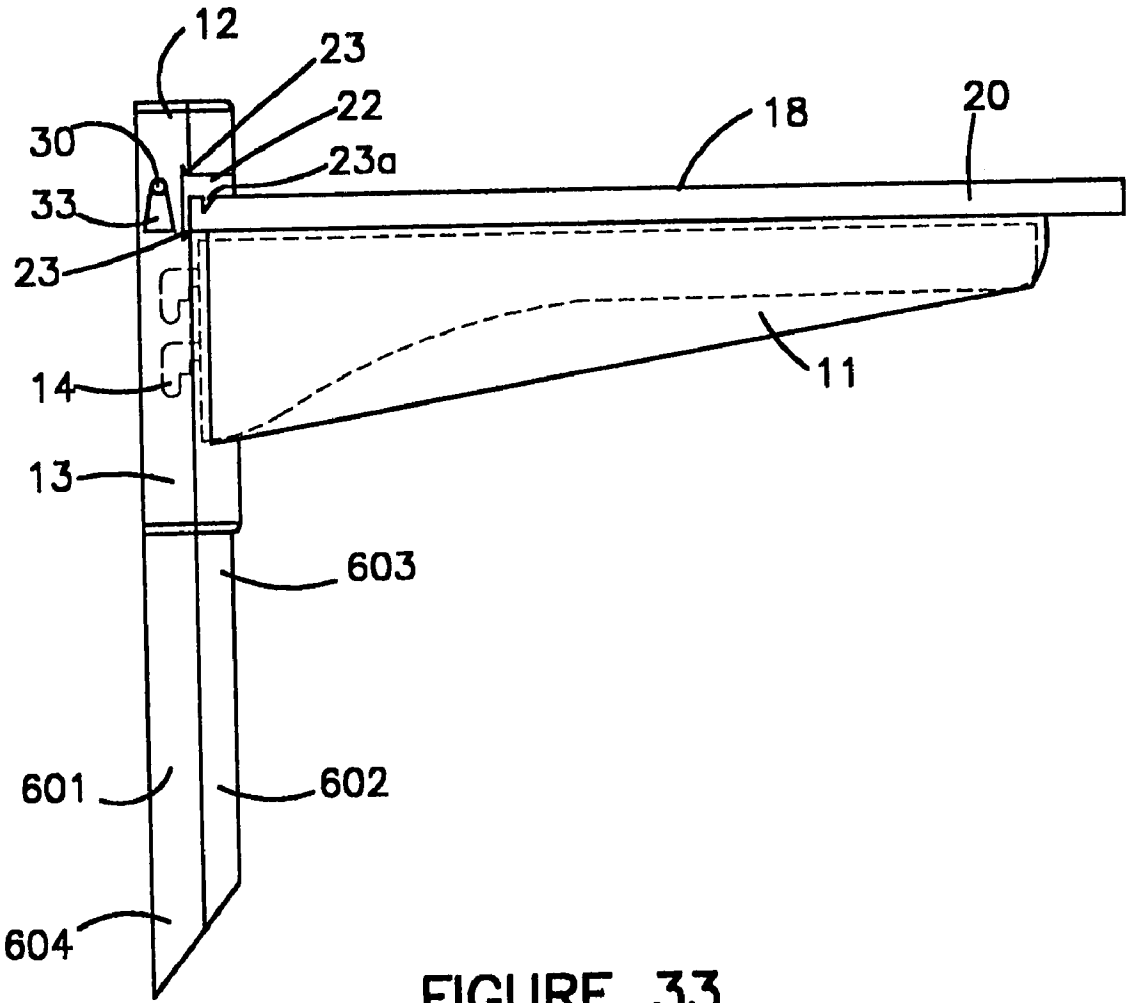
FIG. 33 is a side view of a preferred embodiment of a shelf bracket and a preferred hanging casing.
Figure 35:
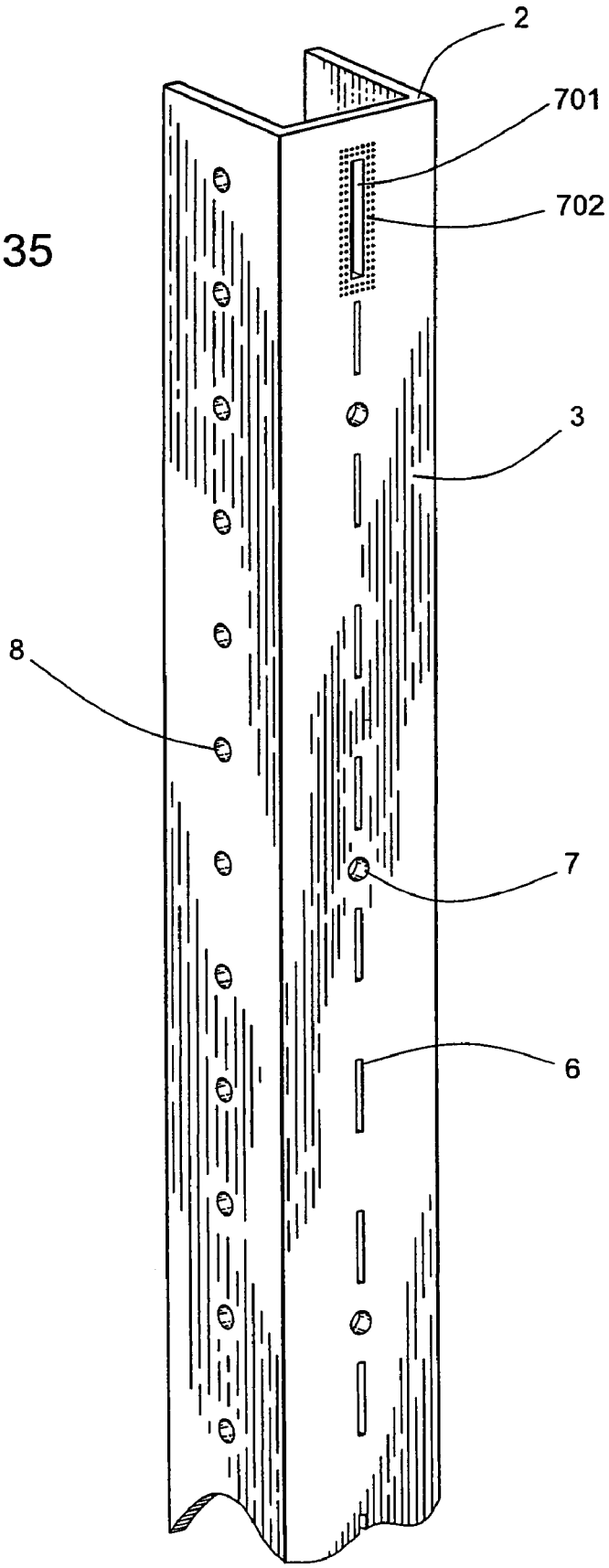
FIG. 35 is a perspective view of a preferred embodiment of a support strip with a mounting slot.
Figure 36:
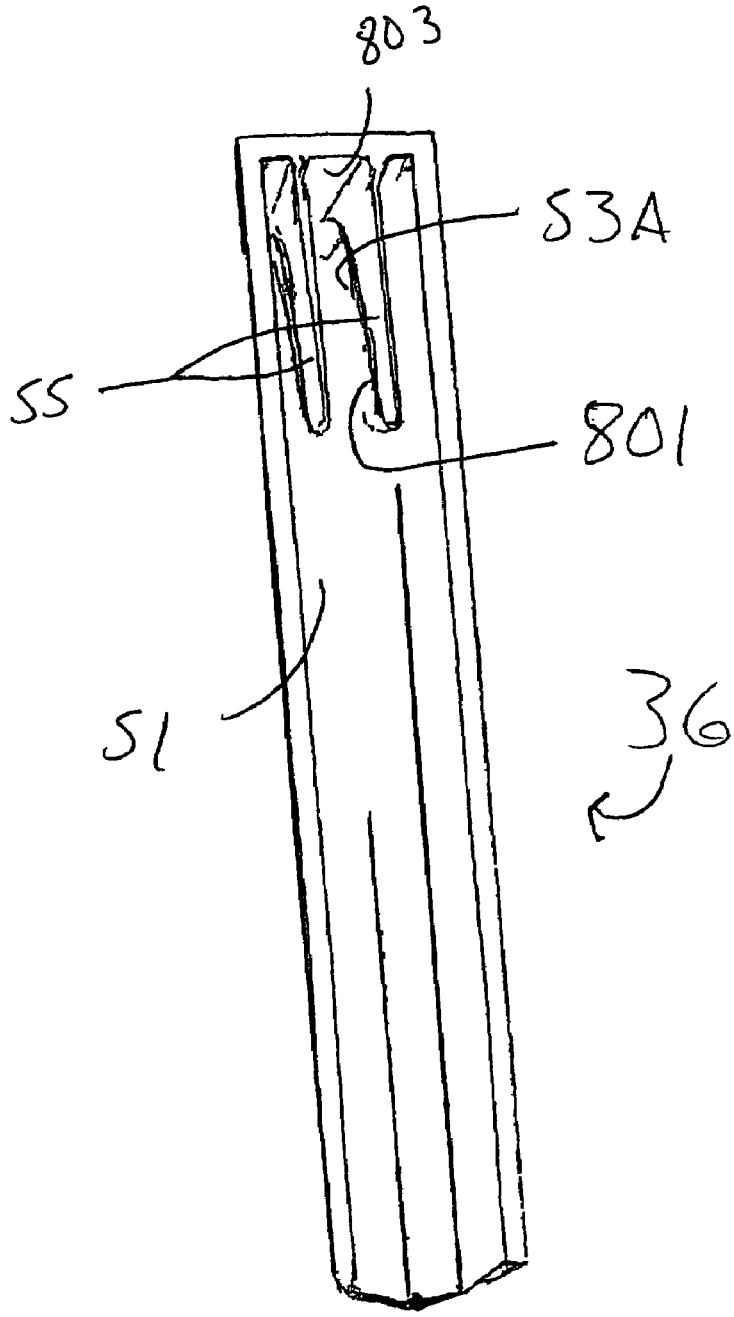
FIG. 36 is a perspective interior view of a preferred embodiment of a cap section.

In one preferred embodiment, shelf 18 is sized so that second end 20 extends beyond the vertical member 24 of support member 11. When shelf 18 is so sized, second end 20 may be enlarged so that it rests against vertical member 24 of support member 11, as illustrated in FIGS. 5C and 5D. This will provide additional support for shelf 18.

Shelf bracket 9 may be provided with a vertical member 24, which extends substantially perpendicularly from support member 11. Vertical member 24 should extend upwardly from support member 11 and should preferably be positioned on support member 11 to correspond to second end 20 of shelf 18. Vertical member 24 is preferably provided with an enlarged head 25. Shelf 18 may be provided with a slot 26 or an indentation 27 sized and positioned to receive vertical member 24 when shelf 18 is placed on bracket 9. Slot 26 or indentation 27 is preferably provided with a deformable constriction 28 sized to engage head 25 of vertical member 24. Deformable constriction 28 may be formed of rubber, plastic, or other resilient material. Deformable constriction 28 should be narrower than the width of head 25, but sufficiently deformable to allow head 25 to pass constriction 28, preferably in both directions, when force is applied to shelf 18.

When shelf 18 is secured to support member 11 at first end 19 with recess 21 and at second end 20 with vertical member 24, it will be prevented from pivoting vertically along its width. If another support member 11 is attached to shelf 18 in a similar fashion at an adjacent support strip 2, shelf 18 will be prevented from pivoting vertically along its length.

In the embodiment where vertical members 24 are secured within indentations 27, vertical member 24 will secure shelf 18 against horizontal displacement as well. Also, where the fit between recess 21 and first end 19 of shelf 18 is sufficiently tight, particularly where shim 22 is used, recess 21 may secure shelf 18 against horizontal displacement as well.

Brackets 9 may be further secured against vertical displacement by providing base 10 with at least one base aperture 30. Base aperture 30 should be sized and positioned to align with strip apertures 8 in support strips 2 when bracket 9 is attached to strip 2. Base aperture 30 may be positioned in hook members 14 or in upper end 12, lower end 13, or horizontal stabilizer 41 of base 10. Shelf bracket assembly 1 may be provided with a locking pin 31. Locking pin 31 should be sized to fit base aperture 30 and strip apertures 8. Locking pin 31 may be inserted in base apertures 30 and strip apertures 8 when bracket 9 is attached to strip 2. Pin 31 will prevent shelf bracket 9 from being vertically displaced. This will secure shelf 18 against displacement, and it will prevent bracket 9 from being disengaged from strip 2. For additional security, pin 31 may be threaded to engage apertures 8 and/or 30. Pin 31 may also be provided with a control arm 32. Control arm 32 should preferably be at approximately a right angle to pin 31. Base 10 may be provided with an arm depression 33 sized and positioned to receive control arm 32 when pin 31 has been inserted in apertures 8 and 30.

Shelf bracket assembly 1 is preferably provided with a cover 34 operatively attached to support strips 2. Cover 34 is configured to completely cover support strips 2 between each shelf bracket 9, in the space above the top shelf bracket 9, and in the space below the bottom shelf bracket 9.

The preferred embodiment of cover 34 utilizes base 10 of shelf bracket 9 and also comprises a number of intermediate sections 35, a cap section 36, atop divider section 37, a bottom section 38, and a bottom divider section 39. Divider sections 35,37, and 39 are of sufficient length to cover support strip 2 between consecutive brackets 9 and also between uppermost shelf bracket 9 and cap section 36 and between bottommost shelf bracket 9 and bottom section 38. Each divider section 35, 37, and 39 is comprised of a divider body 40 having a channel 47 identical in width to channel 46 in shelf bracket 9 in order to completely cover a portion of support strip 2. Also present is an axial clearance groove 48 parallel to channel 46 to allow the heads of screws or other means for attaching support strip 2 to the wall to protrude from support strip 2 without interfering with the proper fitting of divider sections 35, 37, and 39. Each end of intermediate divider sections 35 is sized to fit within the cavity 49 of either upper end 12 or lower end 13 of base 10 and is retained by retainer flange 50 which is the portion of base 10 at upper end 12 and lower end 13 that overlaps divider section 35. The lengths of intermediate divider sections 35 are determined entirely by the spacing between shelf brackets 9.

Cap section 36 includes a body 51 having a downwardly extending retainer flange 52 and a cap cavity 53. Clip 54, which may be plastic, metal, or other sturdy material, extending into cap cavity 53 is formed as an integral part of body 51 and matably engages the upper edge of support strip 2 for attachment. Clip 54 comprises two downwardly extending tabs 55. Tabs 55 are preferably provided with a V-shaped slot 56 and define an engagement space 53A capable of straddling any screws or other hardware used to attach support strip 2 to the wall but yet fit within sidewalls 4 of support strip 2. In another preferred embodiment, tabs 55 may be shaped like an inverted L, with the body section of the L angled toward the base. In this embodiment, engagement space 53A between the inner surface 801 of tabs 55 and the inner surface 802 of cap section 36 will narrow as engagement space 53A approaches the upper surface 803 of cap section 36. As clip 54 passes into support strip 2, the narrowing gap in engagement space 53A will draw cap section 36 closer to the wall on which support strip 2 is mounted.

Cap cavity 53 and retainer flange 52 also act to receive the top end of top divider section 37. Alternatively, cap section 36 may be of sufficient length to engage directly into the next section of cover 34, obviating the need for top divider section 37. In this embodiment, cap section 36 may be cut to length as desired.

Bottom section 38 comprises a body 56 from which hook members 57 extend. Hook members 57 are identical to hook members 14 in structure and function. Hook members 57 retain bottom section 38 on support strip 2 in the same manner that hook members 14 retain shelf bracket 9 on support strip 2. Body 56 contains a channel 58, a left flange 59, and a right flange 60 that are identical in function to their counterparts in divider sections 35, 37, and 39. A lower end 61 extends downwardly from body 41 and is in all respects identical to divider sections 35, 37, and 39, except that lower end 61 is an integral extension of body 56. Body 56 also has an upper end 62 which has a cavity 63 and a retainer flange 64 for retaining the bottom end of bottom divider section 39.

In one preferred embodiment, a modified shelf bracket (not shown) may be used in place of bottom section 38. Modified shelf bracket has all the features of shelf bracket 9 except that lower end 13 is replaced with lower end 61 of bottom section 38.

Shelf bracket assembly 1 may be provided with a vertical stabilizer 66 comprised of an elongated member 67 having a top end 68, a bottom end 69, and an arm 70 extending substantially perpendicularly from elongated member 67. Arm 70 is sized to fit into one of slots 6 in support strip 2. The fit between arm 70 and slot 6 should be substantially tight in order to prevent substantial vertical movement of vertical stabilizer 66 while arm 70 is in slot 6. Vertical stabilizer 66 may also be provided with a lateral brace 72 to prevent horizontal movement while vertical stabilizer 66 is in place, preferably at bottom end 69 and substantially perpendicular to elongated member 67. When arm 70 is placed in slot 6, elongated member 67 will be substantially parallel to support strip 2 and bottom end 69 and preferably lateral brace 72 will be above and in close contact with base 10. In one preferred embodiment, the edge of elongated member 67 containing arm 70 will include one or more indentations 550, preferably immediately adjacent to arm 70. Support strip 2 is frequently secured to wall W with screws. The heads of these screws will typically rest on the surface of support strip 2 that contacts vertical stabilizer 66. Indentations 550 will allow vertical stabilizer 66 rest against support strip 2 without being displaced by the heads of the screws.

When vertical stabilizer 66 is in place, elongated member 67 will fit between support strip 2 and divider section 35, 37, or 39, that is within axial clearance groove 48. The fit between divider section 35, 37, or 39, elongated member 67, and support strip 2 is sufficiently close to prevent arm 70 from being removed from slot 6 with divider section 35, 37, or 39 in place. Lateral brace 72 is sized to fill the remaining space in axial clearance groove 48 and channel 47, thereby securing vertical stabilizer 66 against horizontal displacement. In another preferred embodiment, lateral brace 72 may be sized to substantially fill cavity 49. In this embodiment, divider section 35, 37, or 39 will rest over lateral brace 72. In either embodiment, lateral brace 72 will also provide greater surface area with which stabilizer 66 can engage base 10. The increased surface area of lateral brace 72 will enhance the ability of stabilizer 66 to resist forces tending to vertically displace base 10. In addition to shelf bracket 9, vertical stabilizer 66 may be used to stabilize cabinetry support members 102 (described below) in the same fashion as described herein.

Shelf Bracket 9 is preferably made of a strong metal such as steel or aluminum. Bracket 9 may be provided with a plastic or resinous coating for aesthetic purposes. The coating will provide a functional advantage as well in that it will also increase the width of horizontal support member 11, thereby widening the surface area of the surface supporting shelf 18 and thus enhancing the stability of shelf 18.

In a preferred embodiment of shelf bracket assembly 1, at least two support strips 2 will be mounted on a wall. Support strips 2 should be vertically aligned and positioned parallel to one another. Positioning support strips 2 so that they are perfectly aligned or at least very nearly so, is important to the proper function of shelf bracket assembly 1. If support strips 2 are not aligned, brackets 9 will not be aligned, which will result in shelves 18 either resting at an angle or only resting on one bracket 9.

To facilitate the proper placement of support strips 2, an elongated mounting slot 701 may be provided in face 3 of support strips 2. Mounting slot 701 will preferably have a width that is at least as wide as the diameter of attachment apertures 7, which in turn will be wider than slots 6. In the preferred embodiment, one or more ridges or grooves may extend substantially parallel to or perpendicularly from mounting slot 701 on face 3. Alternatively, face 3 may be provided with a plurality of dimples 702. In operation, support strip 2 may be attached to the wall by driving a screw through mounting slot 701. A second support strip 2 may be attached to the wall in the same manner. A level may then be used to ensure that the first and second support strips 2 are both completely vertical and fully aligned with each other. If adjustments are needed to either support strip 2, it will be possible to pivot them about their respective screws in mounting slots 701 or to move them vertically without removing the screw in mounting slot 701. Once support strips 2 are properly positioned, they may be more permanently secured to the wall by driving screws through attachment apertures 7.

Assembly of cover 34 should preferably be performed from the bottom up. Bottom section 38 is attached first, although modified shelf bracket 65 may be substituted if it is being used. Bottom divider section 39 is attached next by placing it over support strip 2 and pushing the bottom end of bottom divider section 39 down into cavity 63. Bottommost shelf bracket 9 is then positioned over strip 2 so that the top end of bottom divider section 39 is contained within cavity 49 of lower end 13 of base 10. Bottom divider section 39 will thus be held in place by bottommost shelf bracket 9 and bottom section 38. Vertical stabilizer 66, if used, will be placed over bottommost shelf bracket 9 with arm 70 in one of slots 6 so that elongated member 67 is parallel to strip 2. Bottom end 69 of elongated member 67 should be in contact with some portion of base so that bracket 9 cannot be moved upwardly with vertical stabilizer 66 in place. An intermediate divider section 35 will be placed over strip 2 above bottommost shelf bracket 9 and pushed down so that the bottom end of divider section 35 is contained within cavity 49 of upper end 12 of base 10. The top end of divider section 35 will be contained within cavity 49 lower end 13 of base 10 of the next shelf bracket 9. Thus, intermediate divider section 35 will be held in place by these two shelf brackets 9. Divider section 35 will hold vertical stabilizer 66 in place which will prevent bottommost shelf bracket 9 from being vertically displaced or removed from strip 2. Bottommost shelf bracket 9 may also be secured vertically by inserting locking pin 31 through base apertures 30 and strip apertures 8. This procedure is repeated for each successive shelf bracket 35 until top divider section 37 is installed. Above top divider section 37 is placed cap section 36 rather than another bracket 9. Clip 54 of cap section 36 engages the top edge of strip 2. Retainer flange 52 and cap cavity 53 fit over the top end of top divider section 37 and hold it in place. This procedure is repeated for at least one parallel support strip 2. Additional strips 2 may be used if more than two brackets 9 are desired per shelf 18. Brackets 9 attached to each strip 2 should be horizontally aligned.

Shelf 18 may be installed by simply placing it on two or more horizontal support members 11 of aligned shelf brackets 9. When brackets 9 contain a recess 21, first end 19 of shelf 18 should be placed in recess 21. When the fit between recess 21 and first end 19 of shelf 18 is tight, this may be accomplished by placing shelf 18 at an angle on support members 11 and inserting first end 19 into recess 21. Shelf 18 may then be rotated on rounded edge 29 until shelf 18 lies flat against support members 11. Where the fit between shelf 18 and recess 21 is not tight, first end 19 may simply be inserted into recess 21. The fit between recess 21 and first end 19 may then be tightened by inserting shim 22.

Where vertical member 24 is provided on support member 11, shelf 18 will be provided with slot 26 or indentation 27 either of which will be sized to receive vertical member 24 so that vertical member 24 will be positioned inside slot 26 or indentation 27 as shelf 18 is placed flat against support members 11. If vertical member 24 is provided with an enlarged head 25, and indentation 27 or slot 26 is provided with a deformable constriction, slot 26 or indentation 27 will engage vertical member 24 and secure second end 20 of shelf 18 to shelf bracket 9. In some applications, it may be preferable to attach shelf 18 to brackets 9 before attaching brackets 9 to support strips 2. In this application, brackets 9 and shelf 18 may be installed as a unit.

In one preferred embodiment, shelf 18 and support member 11 may be provided with interlocking hook and loop VELCRO® type strips 71 to secure shelf 18 to support member 11. Double sided tape may also be used. In operation one strip 71 should be attached to support member 11 with adhesive while a matching strip 71 should be attached to shelf 18. When shelf 18 is placed on support member 11, strips 71 will engage one another, thereby securing shelf 18 to support member 11 and improving the horizontal and vertical stability of shelf 18. VELCRO® type hook and loop strips 71 are expected to be most useful when shelf 18 is made of glass; however, they may also be used when shelf 18 is made from other materials such as wood or plastic.

In another preferred embodiment, shelf 18 and support member 11 may be provided with a repositionable pressure sensitive adhesive such as the tacky surface active monomers disclosed in U.S. Pat. No. 5,645,556 or the solid, inherently tacky, elastomeric microspheres disclosed in U.S. Pat. Nos. 3,691,140; 3,857,731; 4,166,152; and 5,576,617, all five (5) of which are hereby incorporated by reference in their entirety, to the extent they are not contrary to the teaching of the present application. The application of such adhesives to support member 11 will also allow shelf 18 to be releasably secured to support member 18.

In another preferred embodiment, shelf bracket assembly 1 may be provided with a vertical brace 201. Vertical brace 201 may be used to provide support against vertical displacement of shelf 18. Vertical brace 201 will be primarily useful when Gartung type shelf brackets 9 are used. Vertical brace 201 is comprised of a vertical member 202 having a first end 203, a second end 204, a face 205 and a back 206. A plurality of vertically aligned hook members 207 should be provided on back 206 of vertical member 202. Hook members 207 should be sized to engage slots 6 in support strip 2. Hook members 207 differ from the preferred embodiment of hook members 14 in that hook members 207 should preferably be configured to inhibit movement by vertical member 202 in an upward direction. Hook members 207 are preferably configured so that they have an upper retaining edge 208. The upper edge should preferably create a retaining groove 210A between hook member 207 and vertical member 202. Hook members 207 may be inserted into and removed from slots 6 in support strip 2 by angling them slightly. If vertical brace 201 is pushed upwardly, retaining groove 210A will engage the edges of slots 6 and prevent movement.

Figure 3A:
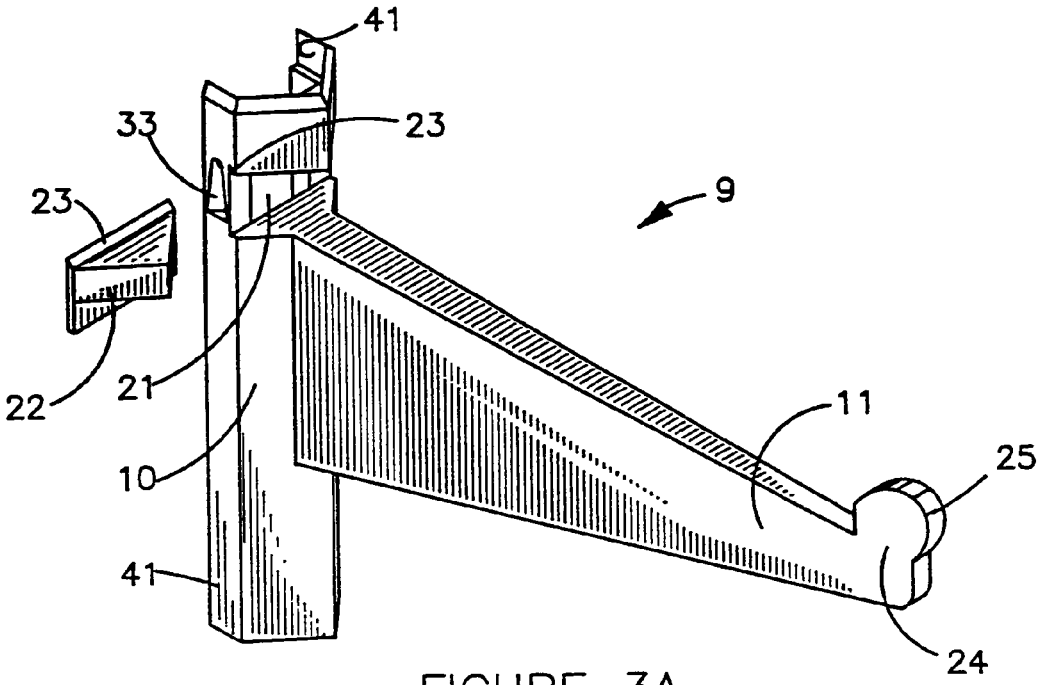
FIG. 3A is an exploded perspective view of a preferred embodiment of a shelf bracket having a shim.
Figure 3B:
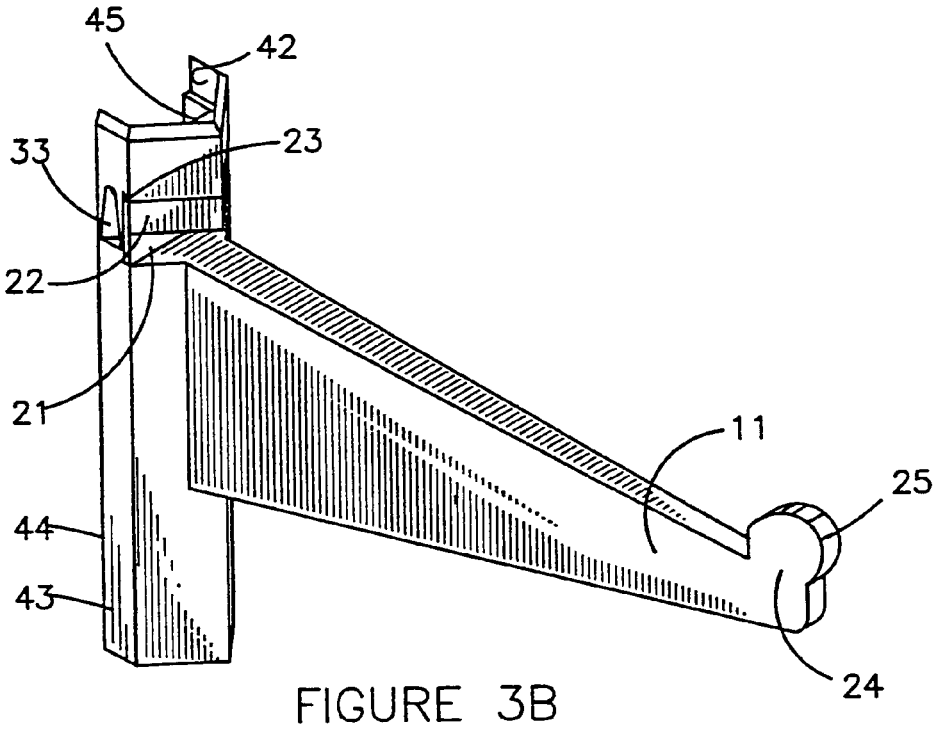
FIG. 3B is a perspective view of a preferred embodiment of a shelf bracket having a shim.
Figure 3C:
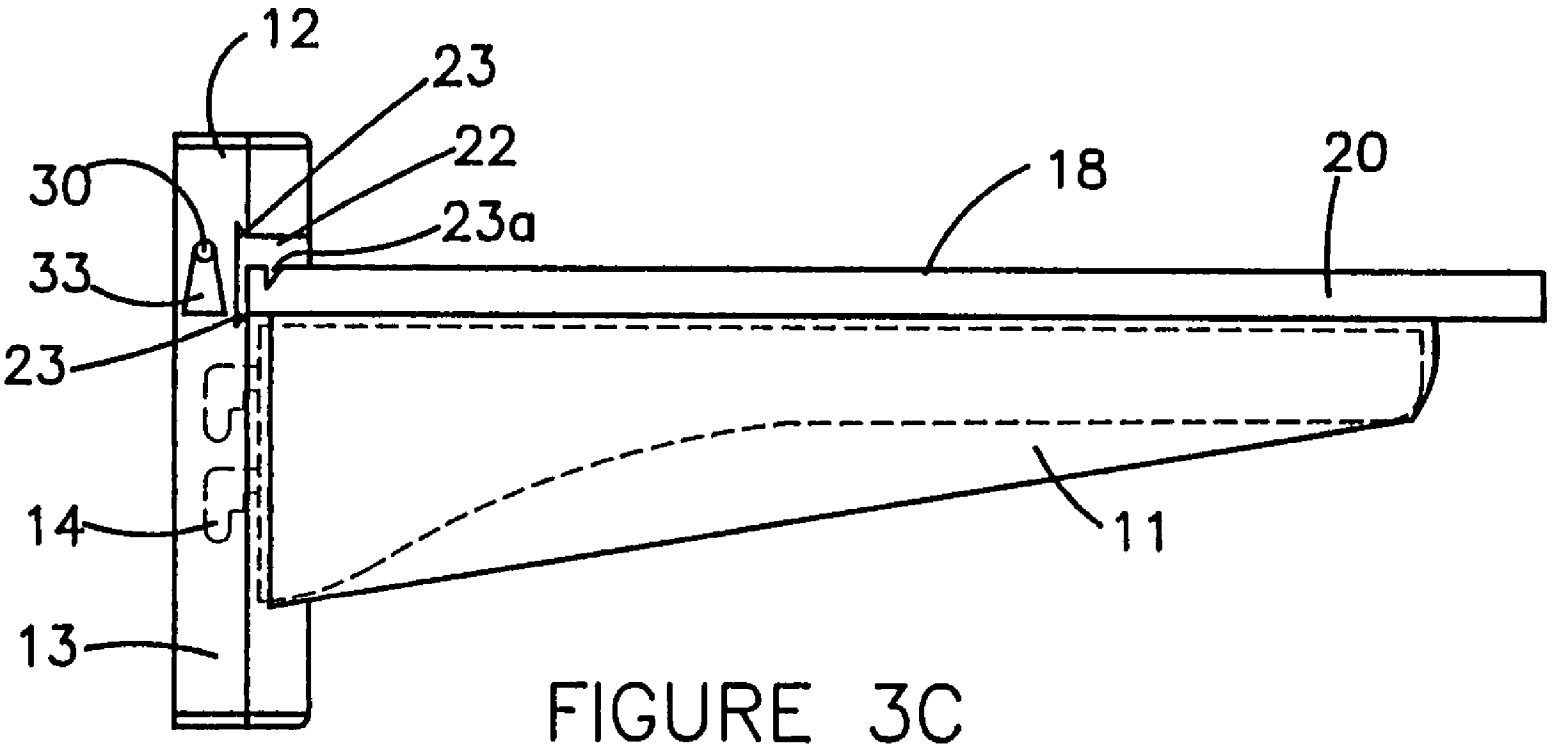
FIG. 3C is a side view of a preferred embodiment of a shelf bracket having a shim with three different tongue and groove engagement mechanisms.
Figure 4A:
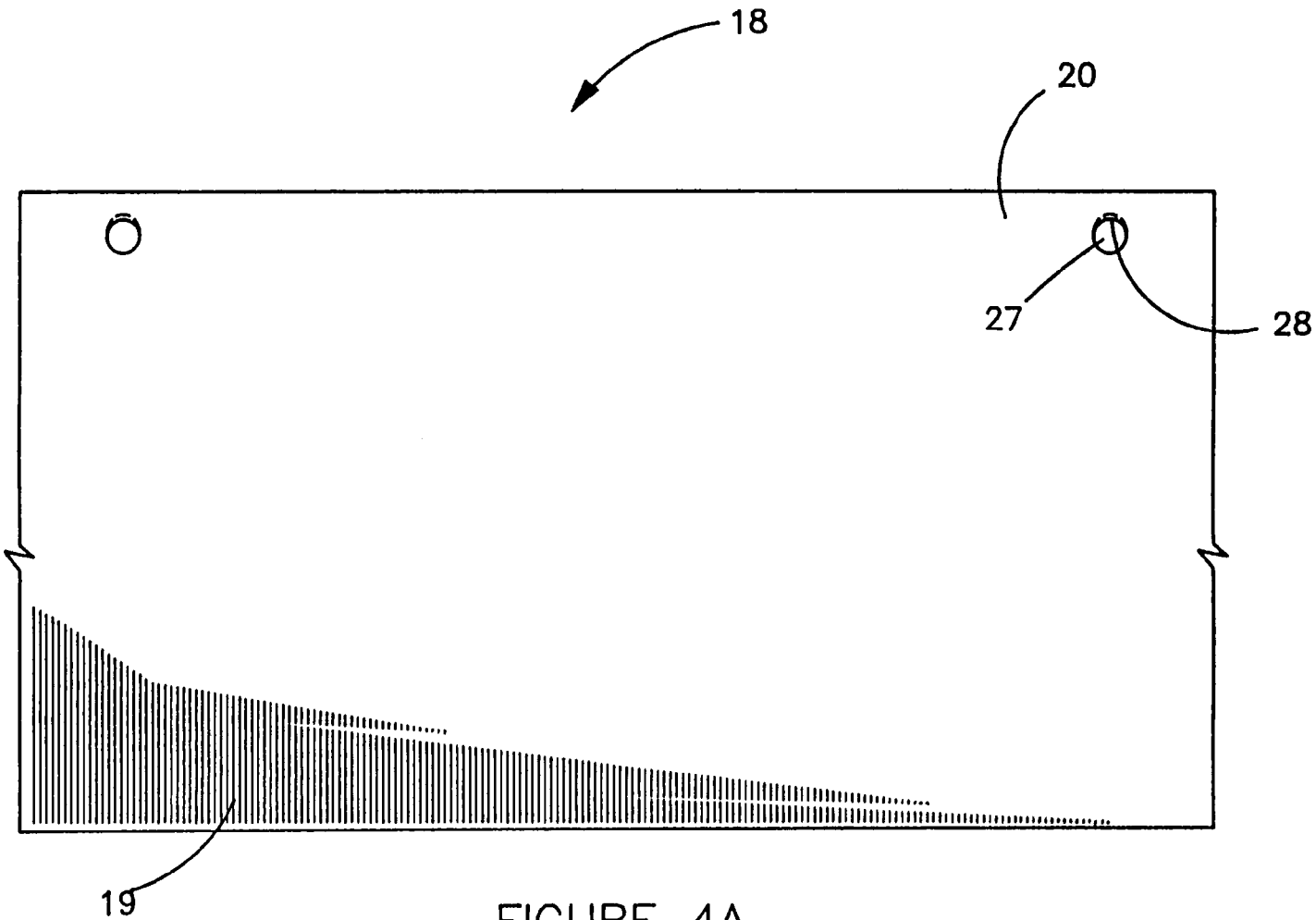
FIG. 4A is a bottom view of a preferred embodiment of a shelf containing an indentation.
Figure 4B:
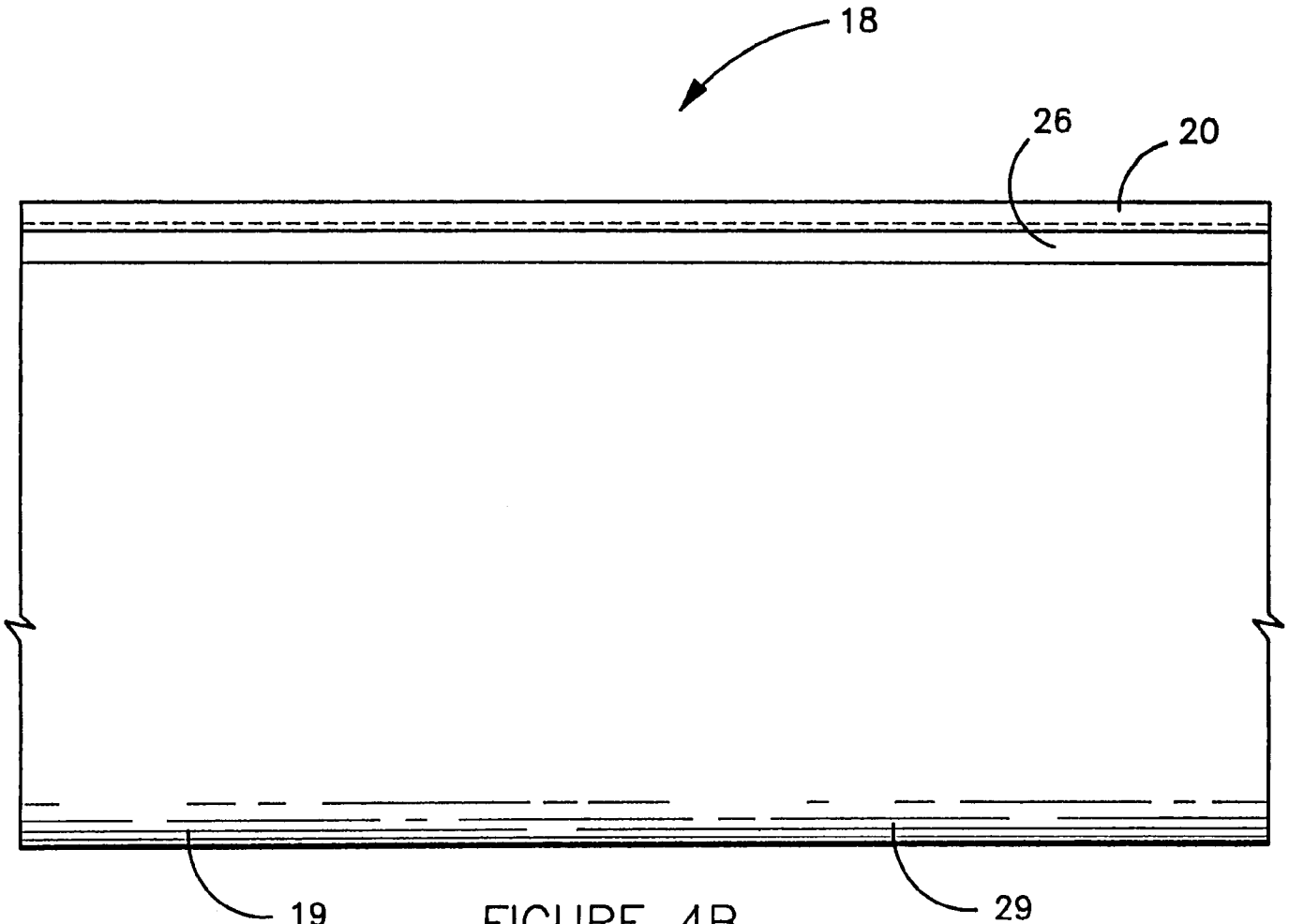
FIG. 4B is a bottom view of a preferred embodiment of a shelf containing a slot.

A brace plate 211 is positioned at second end 204 of vertical member 202. Brace plate 211 should be substantially perpendicular to vertical member 202. In operation, shelf 18 will be installed after vertical brace 201 and shelf bracket 9 are in place. Shelf 18 may be provided with a curved edge as illustrated in FIGS. 5A-5D. Alternatively, the curved edge of shelf 18 may be accomplished by providing shelf 18 with a plurality of angled sections (not shown) rather than the smooth curve shown in FIGS. 5A-5D. Either embodiment will allow shelf 18 to be assembled by angling shelf 18 between brace plate 211 and horizontal support member 11 and then rotating shelf 18 downwardly in the same manner illustrated in FIGS. 5A-5D. Vertical brace 201 should be sized and positioned so that brace plate 211 is adjacent to or in contact with shelf 18 when shelf 18 is substantially aligned with horizontal support member 11. If needed, a shim such as that illustrated in FIGS. 3A-3C may be added between brace plate 211 and shelf 18 in order to take up any space. When vertical brace 201 is in place, it will prevent shelf 18 from being displaced should an upward force be applied against shelf 18.

In another preferred embodiment, a cabinetry assembly 101 is provided. Cabinetry assembly 101 utilizes support strips 2. A plurality of cabinet support members 102 are provided to support one or more cabinets 111. Cabinet support members 102 are comprised of a base 104 having an upper end 105 and a lower end 106. Vertically aligned hooked portions 107 extend from base 104. Hooked portions 107 are configured to lockingly fit within vertical slots 6 in support strip 2. Hooked portions 107 define a groove 108 between hooked portion 107 and base 104. Groove 108 extends from an open mouth 109 and a closed end 110. In a preferred embodiment, groove 108 narrows from open mouth 109 to closed end 110. In another preferred embodiment, groove 108 narrows in discrete steps.

Base 104 should also be provided with a first interlocking member 116 configured to engage a cabinet 111. In one preferred embodiment, base 104 has a shelf 112 which is configured to support a bar 113. In another preferred embodiment, base 104 is provided with an opening 501 sized to receive bar 113. Bar 113 is preferably comprised of a strong metal such as steel or aluminum. Bar 113 may be round, rectangular, triangular, or any other conventional shape in cross section. The ends of bar 113 are preferably provided with a cap for cosmetic purposes and to avoid any sharp edges being exposed. In one preferred embodiment, bar 113 is comprised of three sections, a horizontal section 114 and two vertical sections, 115A and 115B. Vertical section 115A may be shorter than vertical section 115B. Vertical sections 115A and 115B will typically form a right angle with horizontal section 114; however, in one preferred embodiment, vertical section 115A may form an acute angle with horizontal section 114. Vertical sections 115A will usually be the portion of bar 113 that will actually engage cabinet 111. In one preferred embodiment, base 104 will recede toward support strip 2 below shelf 112.

A cabinet 111 will be provided. Cabinet 111 will typically be a six sided rectangular enclosure, although it can be any shape. It may contain doors 130 on its face 117. Alternatively, face 117 may be open. Cabinet 111 will be provided with a second interlocking member 118 which will be configured to operatively engage first interlocking member 116. In one preferred embodiment, second interlocking member 118 comprises an arm 119 extending from the back 131 of cabinet 111 and a lip 120 depending from the end of arm 119. Lip 120 should be sized and configured to engage vertical section 115A of bar 113. Lip 120 may be angled to match the angle of vertical section 115A when that embodiment is used. Back 131 may contain an indentation 121 to receive cabinet support members 102 so that cabinet 111 can hang straight down from bar 113. Alternatively, lip 120 and arm 119 may be sized to extend completely across bar 113.

Back 131 may also be provided with a stop 122. Stop 122 should preferably be placed near the bottom of cabinet 111 and should be sized to rest against wall W or support strip 2 when cabinet 111 is hanging straight down from bar 113.

In another preferred embodiment, first interlocking member 116 will comprise a pin 132 extending substantially horizontally from cabinet support member 102. Pin 132 will engage second interlocking member 118. In this embodiment, second interlocking member 118 may comprise arm 119 and lip 120, under which pin 132 may fit. Alternatively, the sides 123 of cabinet 111 may be provided with a pair of holes 124 sized to receive pin 132.

In one preferred embodiment, at least two support members 102 will be mounted on parallel support strips 2. Bar 113 will rest on shelves 112. Cabinet 111 will hang from bar 113 by arm 119 and lip 120. In another preferred embodiment, the pins 132 of two support members 102 will be inserted into holes 124. With cabinet 111 already suspended therefrom, support members 102 may be mounted on support strips 2.

Base 104 is preferably made of a strong metal such as steel or aluminum. Base 104 may be provided with a plastic or resinous cap 502 for aesthetic purposes. Base 104 and cap 502 may be all one piece of metal, plastic, or resin or other strong conventional material. While cap 502 is aesthetic, it will provide a functional advantage as well in that it will also allow base 104 to rest against the wall, thus enhancing the stability of cabinetry assembly 101. Additionally, where cap 502 is used, upper end 105 and lower end 106 of base 104 can be configured to engage cover 34. As with base 10, base 104 will have a cavity 549 within upper end 105 and preferably lower end 106. Cavity 549 in upper end 105 of base 104 should be sized to receive intermediate divider sections 35 or top divider section 37. Similarly, cavity 549 in lower end 106 will be sized to receive intermediate diver sections 35 or bottom divider section 39, although the latter may be omitted as cabinet 111 will cover support strips 2. Thus, base 104 may be used with cover 34 to conceal support strips 2.

In one preferred embodiment, cap 502

The inner walls of cavity 549 in lower end 106 or the inner walls of cavity 49 in lower end 13 will preferably be provided with a pair of horizontal grooves 606. These grooves will allow a preferred hanging casing 601 to be used with cover 34. Hanging casing 601 comprises an elongated body 602 having an upper end 603 and a lower end 604 and a channel 605 similar in width to channel 46 in shelf bracket 9 in order to completely cover a portion of support strip 2. Channel 605 should be deep enough to allow the heads of screws or other means for attaching support strip 2 to the wall to protrude from support strip 2 without interfering with the proper fitting of hanging casing 601. Upper end 603 of hanging casing 601 is sized to fit within cavity 49 of lower end 13 of base 10 or cavity 549 of lower end 106 of base 104. Upper end 603 of hanging casing 601 should be provided with a tongue or rod 607 sized to engage grooves 606. When hanging casing 601 is inserted into cavity 549 of lower end 106 or cavity 49 of lower end 13, tongue or rod 607 will engage grooves 606 so that hanging casing 601 will be suspended from lower end 13 of base 10 or lower end 106 of base 104. When support strip 2 extends below base or base 104 about five inches or less, hanging casing 601 can be used to cover this lower portion of support strip 2 without using bottom section 38. When hanging casing 601 is used, it should preferably angle slightly with respect to lower end 106, 13 to facilitate hanging casing 601 resting flush against a wall.

Shelf brackets 9 may also be attached to support strips 2 so that shelves 18 may be used with cabinets 111. Shelf brackets 9 will function in the same manner described above. The description of shelf brackets 9 and the various other previously described components of the preferred embodiments of shelf bracket assembly 1, locking pin 31, groove 15, and vertical stabilizer 66 may be used equally well with cabinetry assembly 101, in much the same way as cover 34 described above, and their descriptions need not be repeated herein.

In another preferred embodiment, brackets 9 may be provided with apertures 250. Apertures 250 should be sized to receive a rod 251. Rod 251 may be supported by two or more brackets 9. In place, rod 9 can serve as a closet rod from which coat hangers and other hooked hangers may be supported.

There are, of course, alternate embodiments which should be obvious to those of ordinary skill in the art in view of the foregoing description of the invention which are intended to be included within the scope of the following claims.

We claim:

1. A shelf bracket assembly comprising:

(a) a plurality of vertical support strips operatively attached to a wall, each said strip having a plurality of slots aligned vertically along the length of said support strips;

(b) a plurality of shelf brackets operatively attached to said support strips, each said bracket comprising:

(i) a base comprising an upper end, a lower end, and vertically aligned hooked portions between said upper and lower ends of a size and shape to lockingly fit within said vertical slots of said support strip; and (ii) a horizontal support member fixedly connected to said base and of a size and strength capable of supporting at least half the weight of a shelf;

wherein at least two of said horizontal support members have second ends, each said second end containing an aperture sized and configured to receive a rod, wherein said rod may be supported between said apertures of said horizontal support members;

(iii) wherein said brackets further comprise a recess in said base above said support member sized to receive a first end of said shelf;

(iv) a shim sized to fit in said recess above said shelf whereby said shelf may be secured against said support member.

2. A shelf bracket assembly according to claim 1 further comprising a first velcro strip configured to be secured to said support member and a second velcro strip configured to be secured to said shelf, whereby said first strip will engage said second strip when said shelf is placed in contact with said support member.

3. A shelf bracket assembly according to claim 1 further comprising a pressure sensitive adhesive for securing said shelf to support member.

4. A shelf bracket assembly according to claim 3 wherein said pressure sensitive adhesive is repositionable whereby said shelf support member may be releasably secured.

* * * * *